US009076613B2

(12) United States Patent
Neilly et al.

(10) Patent No.: US 9,076,613 B2
(45) **Date of Patent: *Jul. 7, 2015**

(54) METHOD OF THERMALLY OPERATING AN ELECTRICAL INTERRUPT SWITCH

(76) Inventors: William C. Neilly, Palm City, FL (US); Kevin L. Gabrey, Port St. Lucie, FL (US)

( * ) Notice: Subject to any disclaimer, the term of this patent is extended or adjusted under 35 U.S.C. 154(b) by 827 days.

This patent is subject to a terminal disclaimer.

(21) Appl. No.: 13/303,537

(22) Filed: Nov. 23, 2011

(65) Prior Publication Data

US 2012/0068811 A1 Mar. 22, 2012

Related U.S. Application Data

(60) Division of application No. 12/475,829, filed on Jun. 1, 2009, now Pat. No. 8,081,058, which is a continuation-in-part of application No. 12/136,179, filed on Jun. 10, 2008, now Pat. No. 7,652,553.

(60) Provisional application No. 61/159,424, filed on Mar. 11, 2009, provisional application No. 61/148,383, filed on Jan. 29, 2009.

(51) Int. Cl.

| | |
|---|---|
| ***H01H 69/00*** | (2006.01) |
| ***H01H 37/46*** | (2006.01) |
| ***H01H 37/60*** | (2006.01) |
| ***H01H 37/44*** | (2006.01) |
| ***H01H 11/00*** | (2006.01) |
| ***H01H 37/04*** | (2006.01) |
| ***H01H 37/40*** | (2006.01) |
| ***H01H 37/64*** | (2006.01) |
| ***H01H 37/70*** | (2006.01) |

(52) U.S. Cl.

CPC ..... *H01H 37/44* (2013.01); *H01H 11/00* (2013.01); *H01H 37/043* (2013.01); *H01H 37/40* (2013.01); *H01H 37/46* (2013.01); *H01H 37/60* (2013.01); *H01H 37/64* (2013.01); *H01H 37/70* (2013.01)

(58) Field of Classification Search

CPC ..... H01H 37/043; H01H 37/40; H01H 37/44; H01H 37/70; H01H 37/60; H01H 37/64; H01H 37/46; H01H 11/00

USPC ..... 337/315, 384, 393, 123, 382, 386, 388; 29/623, 622

See application file for complete search history.

(56) References Cited

U.S. PATENT DOCUMENTS 3,131,269 A * 4/1964 Asakawa ..... 337/139
3,386,065 A * 5/1968 Algino ..... 337/315

(Continued)

*Primary Examiner* — Anatoly Vortman

(74) *Attorney, Agent, or Firm* — Gold & Rizvi, P.A.; Glenn E. Gold

(57) ABSTRACT

A thermally activated electrical interrupt device incorporates a thermally activated portion engaging with an electrical interrupt portion. The thermally activated material expands when heated, causing an interrupt control rod to open an electrical contact. When the interrupt device is placed into an interrupt state, a reset mechanism maintains the interrupt control rod in the interrupt state until specifically reset. An actuating shaft is in operational communication with at least one electrical contact. The actuating shaft is maintained in a thermal monitoring position until an interrupt control rod is moved via a thermally expanding material and engages with the actuating shaft, releasing it from the thermal monitoring position. The actuating shaft is projected via a biasing member to cause a change in state of the electrical contact. The actuating shaft remains in the interrupt state until the user resets the switch.

19 Claims, 42 Drawing Sheets

(56) References Cited

U.S. PATENT DOCUMENTS

| | | | | | |
|---|---|---|---|---|---|
| 3,613,041 | A | * | 10/1971 | Graber | 337/315 |
| 3,691,501 | A | * | 9/1972 | Katchka et al. | 337/393 |
| 3,768,925 | A | | 10/1973 | Klemm | |
| 3,784,095 | A | * | 1/1974 | Bilbrey | 236/101 R |
| 3,882,479 | A | * | 5/1975 | Szeverenyi | 340/622 |
| 4,225,841 | A | * | 9/1980 | Saur et al. | 337/393 |
| 4,270,694 | A | | 6/1981 | Knauth | |
| 4,610,603 | A | | 9/1986 | Norman | |
| 4,646,195 | A | | 2/1987 | Lisauskas | |
| 5,145,322 | A | | 9/1992 | Senior, Jr. et al. | |
| 5,779,460 | A | | 7/1998 | Marz | |
| 5,828,287 | A | | 10/1998 | Nilson | |
| 5,897,055 | A | * | 4/1999 | Saur et al. | 337/393 |
| 6,404,321 | B1 | * | 6/2002 | Buschatz | 337/393 |
| 6,460,335 | B1 | * | 10/2002 | Buschatz | 60/527 |
| 6,764,020 | B1 | * | 7/2004 | Zhao et al. | 236/68 R |
| 6,837,688 | B2 | | 1/2005 | Kimberlin et al. | |
| 7,617,989 | B2 | * | 11/2009 | Caleffi | 236/99 R |

* cited by examiner

METHOD OF THERMALLY OPERATING AN ELECTRICAL INTERRUPT SWITCH

REFERENCE TO RELATED APPLICATIONS

This Application is a Divisional Patent Application of U.S. Non-Provisional patent application Ser. No. 12/475,829 filed on Jun. 1, 2009, which is a Continuation-In-Part of U.S. Non-Provisional patent application Ser. No. 12/136,179, filed Jun. 10, 2008, which issued as U.S. Pat. No. 7,652,553, and wherein U.S. Non-Provisional patent application Ser. No. 12/475,829 further claims priority to U.S. Provisional application Ser. No. 61/159,424, filed on Mar. 11, 2009 and Ser. No. 61/148,383, filed on Jan. 29, 2009; all of which are in the name of the same inventors, and all of which are incorporated in their entireties herein.

BACKGROUND OF THE INVENTION

1. Field of the Invention

The present invention relates generally to an electrical interrupt device. More particularly, the present invention relates to a thermally activated electrical interrupt device for thermal protection of motors, pumps, related piping and equipment.

2. Description of the Prior Art

A generic thermal switch device is known in the prior art. The general concept provides a thermally reactive material, which causes an electrical circuit to open when the temperature of the thermal material is elevated above a predetermined temperature. Several teachings utilize an actuator, which moves axially based upon an increase in heat to the device, to separate the electrical communication between a cantilevered contact member and a second, stationary contact member. When cooled, the actuator returns to a normal state, closing the electrical communication between the cantilevered contact member and the second, stationary contact member.

The thermal switches are limited whereby, the known devices allow the system to cycle between a thermally alarming and thermally acceptable state. This can continue until recognized and respectfully repaired.

Cantilevered electrical connections can bend, causing different angles required for separation. This can affect repeatability of the activation temperature.

Therefore, a reliable and repeatable thermally activated electrical interrupt switch capable of indicating an over-temperature condition is needed.

SUMMARY OF THE INVENTION

The invention is directed to a thermally activated electrical interrupt switch incorporating an optional mechanical reset mechanism.

In one general aspect of the present invention, the thermally activated electrical interrupt switch may include:

a thermally active material that expands when subjected to heat;

an interrupt control rod engaging with said thermally active material in a manner whereby said control rod is moved by the displacement of said thermally active material;

an electrical contact which is operated by the movement of the interrupt control rod; and a reset mechanism that secures the interrupt control rod in location when the apparatus is placed in an interrupt state.

Another aspect of the present invention provides a thermally active material being a liquid, gel, wax, and the like having at least one of a diaphragm interface and a piston interface between the thermal material and the interrupt control rod.

Yet another aspect utilizes a formed disc as the thermally active material, wherein the center of the disc expands outward when heated.

In a further aspect of the present invention, an electrical interrupt circuit is provided via one or more pairs of contacts being electrically connected via a circuit controlling contact and/or one or more cantilevered contacts electrically connected to a fixed contact.

In still a further aspect of the present invention, the reset mechanism includes a notch located within the interrupt control rod.

While another aspect places the notch against a holding member, the holding member being selected from a group comprising an edge of a bushing and a reset control rod distal end.

In yet another aspect resets the apparatus via a motion of the reset control rod, the motion being generally perpendicular to the interrupt control rod.

While another aspect incorporates at least one biasing member or return spring for controlling the displacement of at least one of the interrupt control rod and the thermal expanding material. Components of the circuit switch can be used as the biasing member.

And another aspect utilizes a control rod having a tapered distal end that engages with a tapered proximal end of an interrupt rod. The control rod is activated by the thermal motor. The thermal motor can be of a thermal wax, an expansion disc, and the like. A tapered end of the control rod engages with the tapered proximal end of the interrupt rod, causing the interrupt rod to adjust laterally, releasing the interrupt rod from a latched engagement. An activation biasing member (preferably a compression spring) can be incorporated to ensure a rapid change from a closed circuit to an open circuit.

With another aspect incorporating a return spring, used to ensure at least one of the control rod and the interrupt rod to return to a closed circuit or operational state.

An additional aspect incorporates a configuration that compensates for tolerances between the circuit contact and the respective circuit contact terminals. The circuit contact(s) can be slideably assembled to the interrupt rod. A spring can be utilized to ensure the contact remains in electrical communication with the respective circuit contact terminals. A plurality of electrical circuits can be incorporated, having like, opposing or any combination therein configuration.

Wherein another aspect utilizes a slideable or pivotal reset configuration. A weatherproof seal can be incorporated to ensure the electrical interrupt switch maintains operational integrity.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Shown throughout the Figures, the invention is directed to a thermally activated electrical interrupt switch, presenting various deviations of the generic invention.

Figure 1:
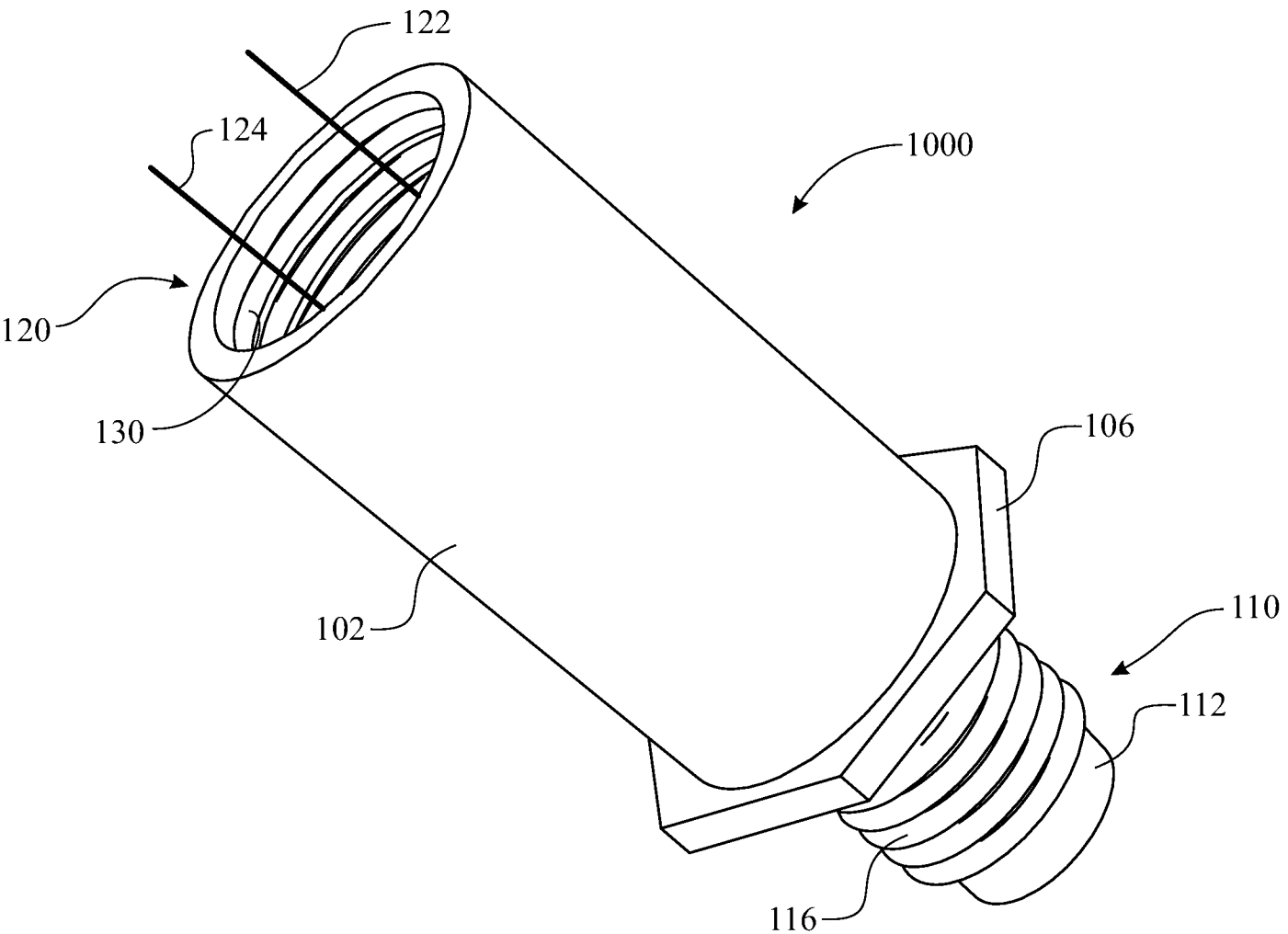
FIG. 1 is an isometric view of a thermally activated electrical interrupt switch.
Figure 2:
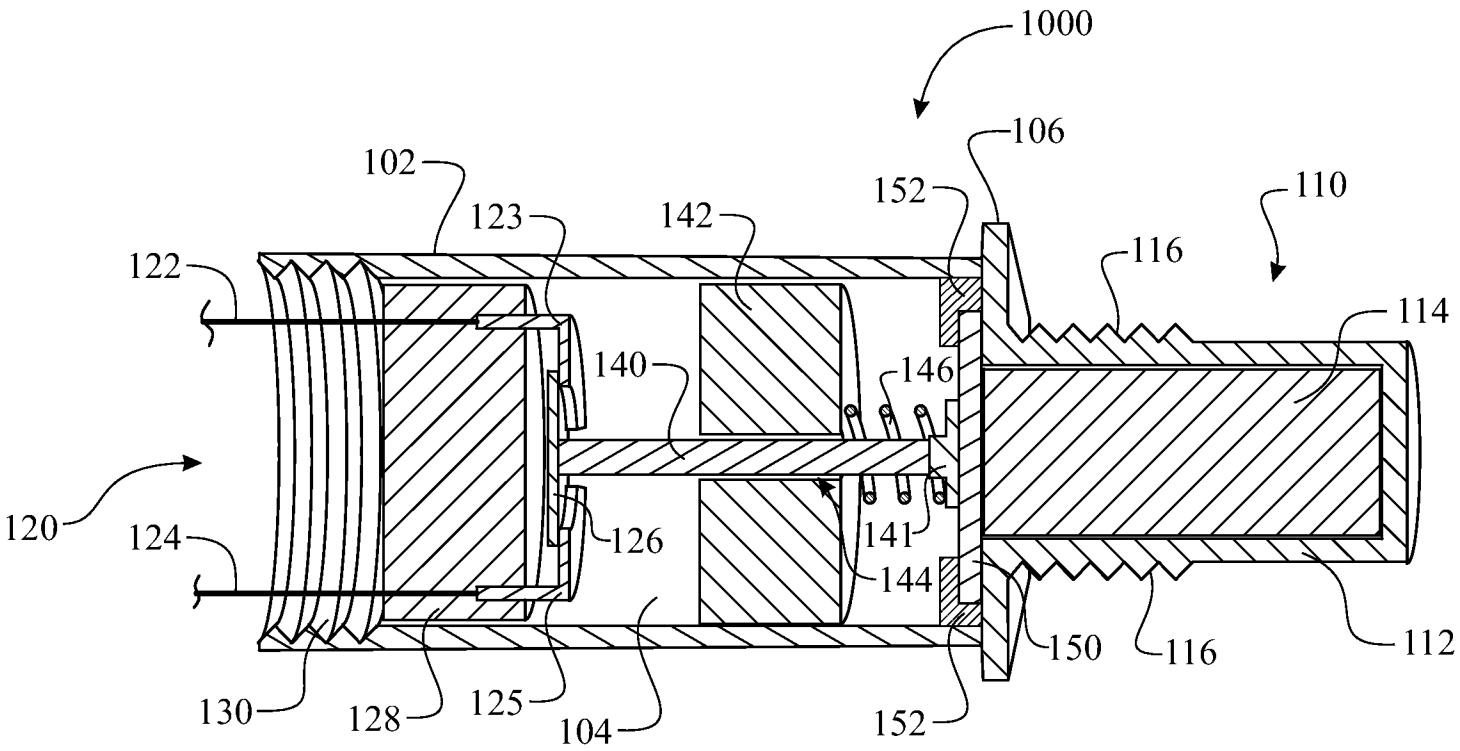
FIG. 2 is a sectioned elevation view of the thermally activated electrical interrupt switch as presented in FIG. 1 being sectioned along the central longitudinal axis, with the switch shown in a closed circuit state.
Figure 3:
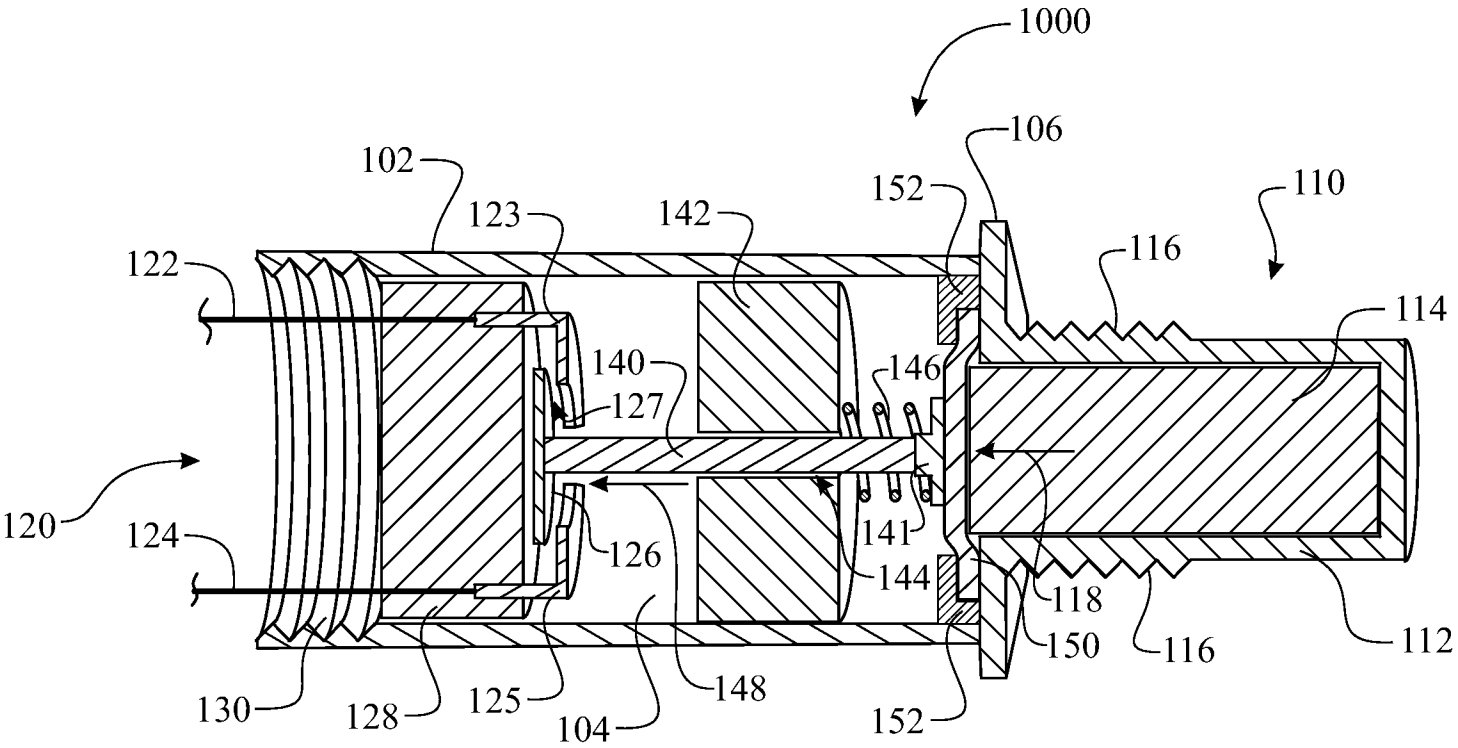
FIG. 3 is a sectioned elevation view of the thermally activated electrical interrupt switch as presented in FIG. 2 shown in a circuit interrupt state.

A thermally activated electrical interrupt apparatus 1000 is initially represented in an isometric view illustrated in FIG. 1. The thermally activated electrical interrupt apparatus 1000 is configured in two sections; an interrupt housing 102 and a thermally activated engine portion 110. The interrupt housing 102 contains the electrical contact functioning portion of the thermally activated electrical interrupt apparatus 1000 within a housing cavity 104 (FIGS. 2 and 3). The thermally activated engine portion 110 contains the thermally active portion of the thermally activated electrical interrupt apparatus 1000. The thermally activated engine portion 110 is fabricated having a thermal transfer housing portion 112 and a thermal coupling threading 116 for installing the thermally activated electrical interrupt apparatus 1000 into a pump or other device. The interrupt housing 102 includes an electrical interface portion 120 for providing electrical communication (via a first electrical conductor 122 and a second electrical conductor 124) between the thermally activated electrical interrupt apparatus 1000 and the operating circuit of the monitored pump. An electrical seal threading 130 can be formed (internally as shown or externally) about the electrical interface portion 120, providing a weather seal. The electrical seal threading 130 is an exemplary embodiment and it is understood that any known interconnection can be used, such as a slip joint, and the like. An assembly collar 106 is preferably disposed upon the interrupt housing 102 proximate the thermally activated engine portion 110 providing a means for tightening the thermal coupling threading 116 during installation. The assembly collar 106 can be of any geometric form factor, preferably being a commonly used hexagonal shape.

Figure 10:
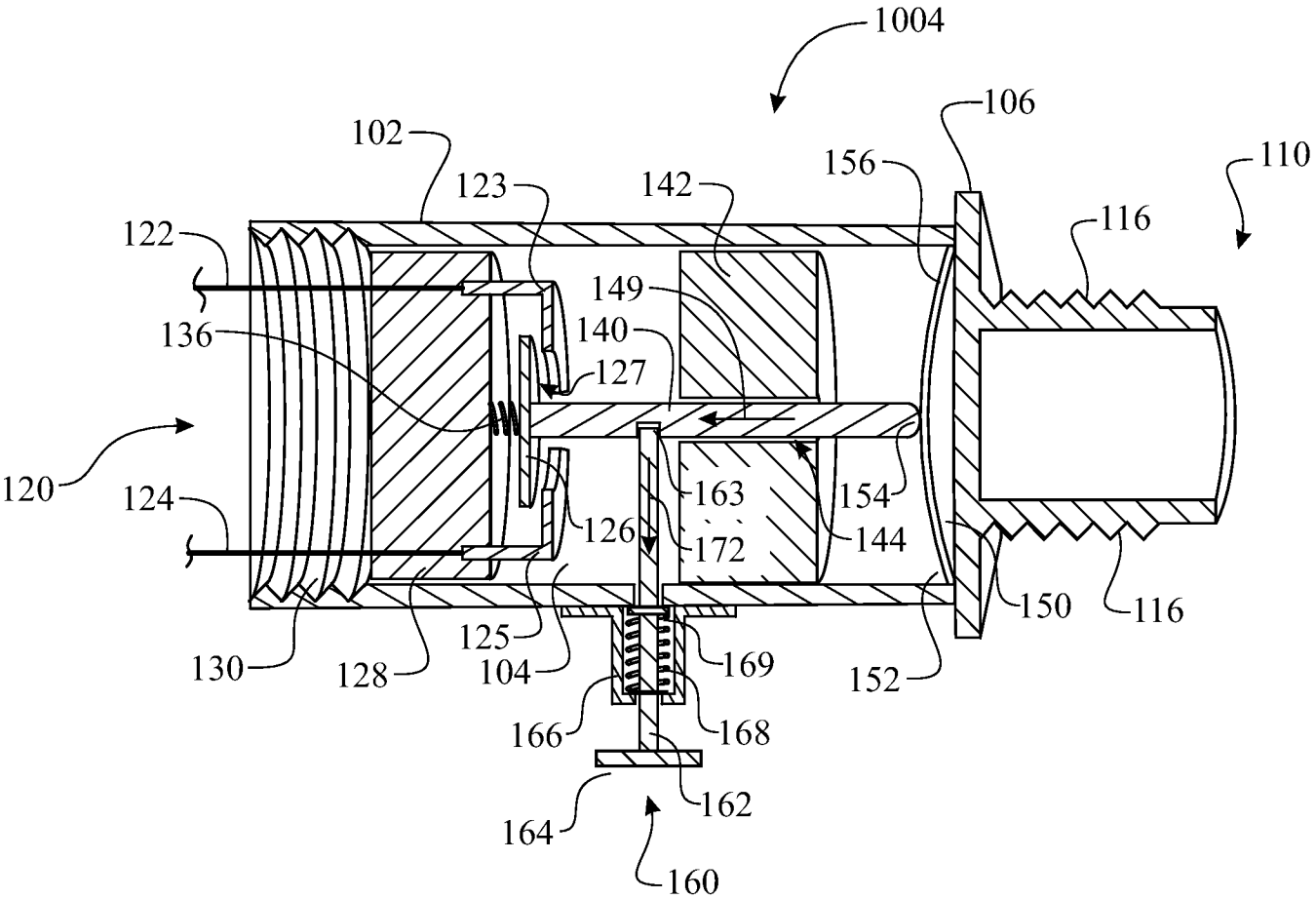
FIG. 10 is a sectioned elevation view of the thermally activated electrical interrupt switch incorporating a plunger contact configuration having a return force applied via an end compression spring.
Figure 11:
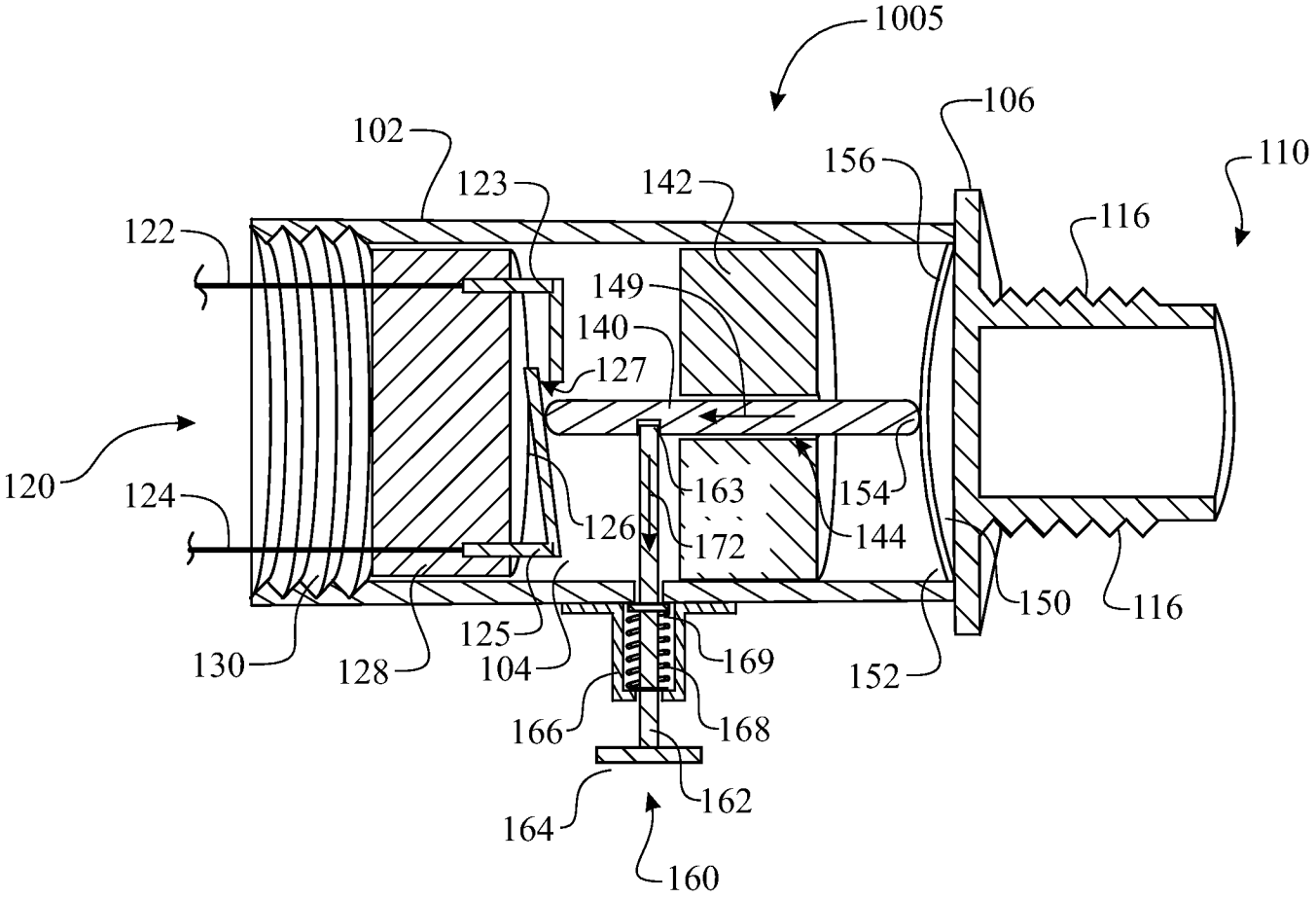
FIG. 11 is a sectioned elevation view of the thermally activated electrical interrupt switch incorporating a cantilevered contact configuration as presented in FIG. 9 shown in a circuit interrupt state.

Functionally of the thermally activated electrical interrupt apparatus 1000 is better presented in sectional FIGS. 2 and 3. A thermally expanding material 114 is encapsulated within the thermal transfer housing portion 112, expanding against a compliant member, such as a diaphragm 150. The thermally expanding material 114 can be a liquid, a gel, a wax, and the like, as well as being tailored to a desired temperature range for a desired expansion rate. The diaphragm 150 is a pliant material and secured via a diaphragm collar 152. An interrupt control rod 140 is slideably assembled through a rod passage 144 of a control rod bushing 142. A control rod flange 141 can be formed on the thermal end of the interrupt control rod 140 for an improved interface between the interrupt control rod 140 and the diaphragm 150. A control rod return spring 146 resides between the control rod bushing 142 and the control rod flange 141, ensuring the interrupt control rod 140 remains seated against the diaphragm 150 and exerts contact pressure to ensure a good electrical contact between the electrical contact 126 and the terminals 123 and 125. A circuit controlling contact 126 is disposed upon the electrically controlling end of the interrupt control rod 140. The circuit controlling contact 126 provides either an electrical circuit (FIG. 2) or an interrupt circuit (FIG. 3) between a first electrical contact terminal 123 and a second electrical contact terminal 125. The interrupt circuit is generated when a contact separation 127 is created between the circuit controlling contact 126 and at least one of the first electrical contact terminal 123 and the second electrical contact terminal 125. The circuit state is conveyed to the monitored device via an electrical communication between the first electrical conductor 122 and the first electrical contact terminal 123/the second electrical conductor 124 and the second electrical contact terminal 125. A circuit mounting member 128 can be incorporated for assembling and maintaining the electrical contact terminals 123, 125, while additionally providing a watertight/weatherproof seal. The thermally activated electrical interrupt apparatus 1000 is operated via a thermal transfer of heat from the monitored device to the thermally expanding material 114 via the thermal transfer housing portion 112. It is preferred the thermal transfer housing portion 112 be of a thermally conductive material such as metal. As the temperature of the thermally expanding material 114 rises, the thermally expanding material 114 expands applying an expansion force 118 to the diaphragm 150. The motion of the diaphragm 150 is transferred to the interrupt control rod 140 (causing an interrupt generating motion 148), separating the circuit controlling contact 126 from the terminals 123, 125 against a return force applied via an end compression spring 136 (FIG. 10), creating the contact separation 127, thus an open circuit. The end compression spring 136 is disposed between the circuit controlling contact 126 and the circuit mounting member 128. When the thermally expanding material 114 cools, the control rod return spring 146 ensures the interrupt control rod 140, the electrical contact 126, and the diaphragm 150 return to the normal, closed contact state.

Figure 4:
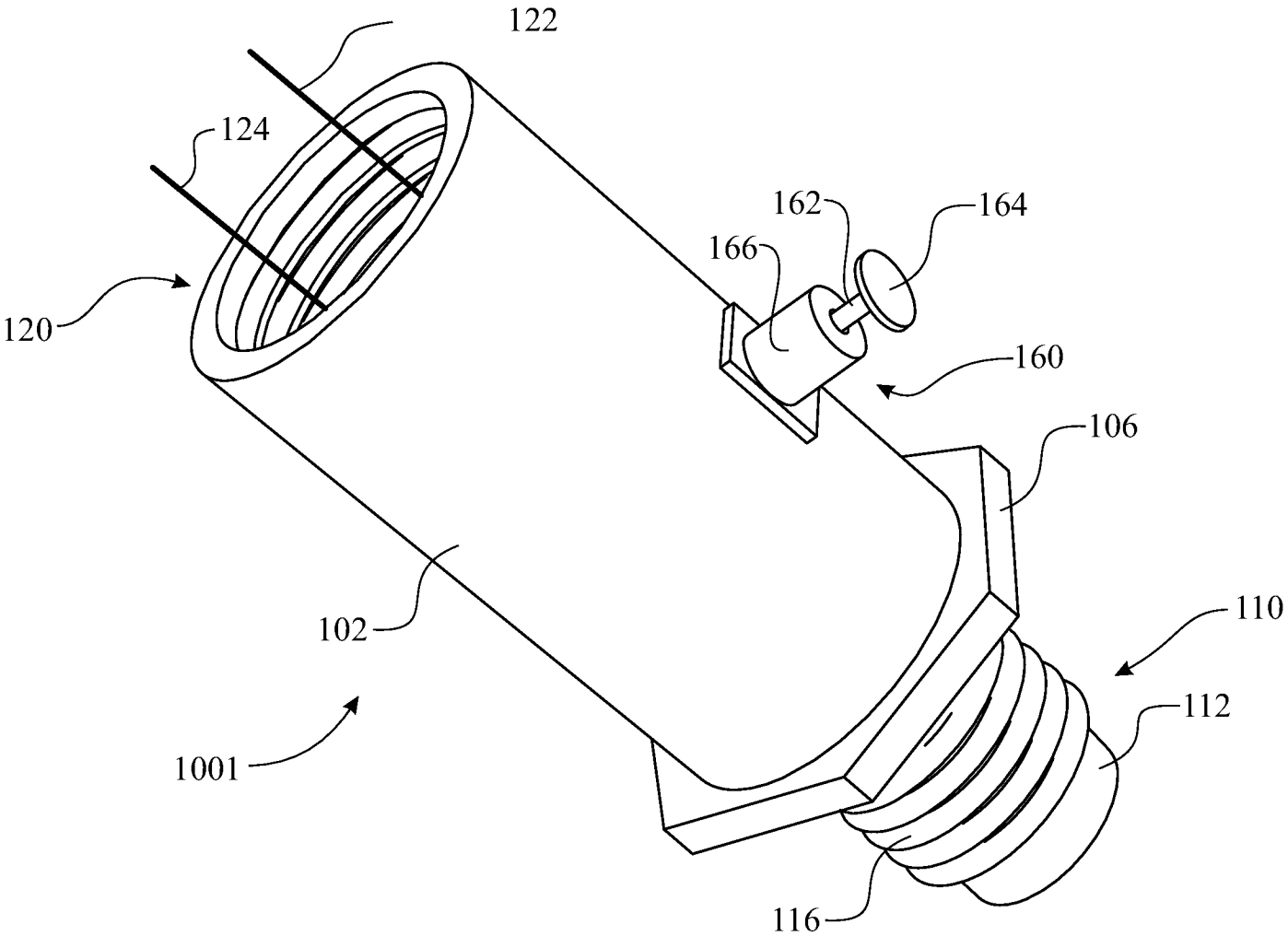
FIG. 4 is an isometric view of a thermally activated electrical interrupt switch, incorporating a reset mechanism.

An enhanced embodiment presenting a thermally activated electrical interrupt apparatus 1001, which includes a reset mechanism 160 and is presented as an isometric view in FIG. 4. The reset mechanism 160 provides a reset button 164 as a user interface. The user pulls (or presses as in FIGS. 16-18) the reset button 164, which, in turn, repositions a reset control rod 162. The reset control rod 162 is slideably assembled through a reset mechanism housing 166, which is disposed upon the interrupt housing 102. The engaging portion of the reset mechanism 160 can be provided in a variety of form factors, with several embodiments being presented herein.

Figure 5:
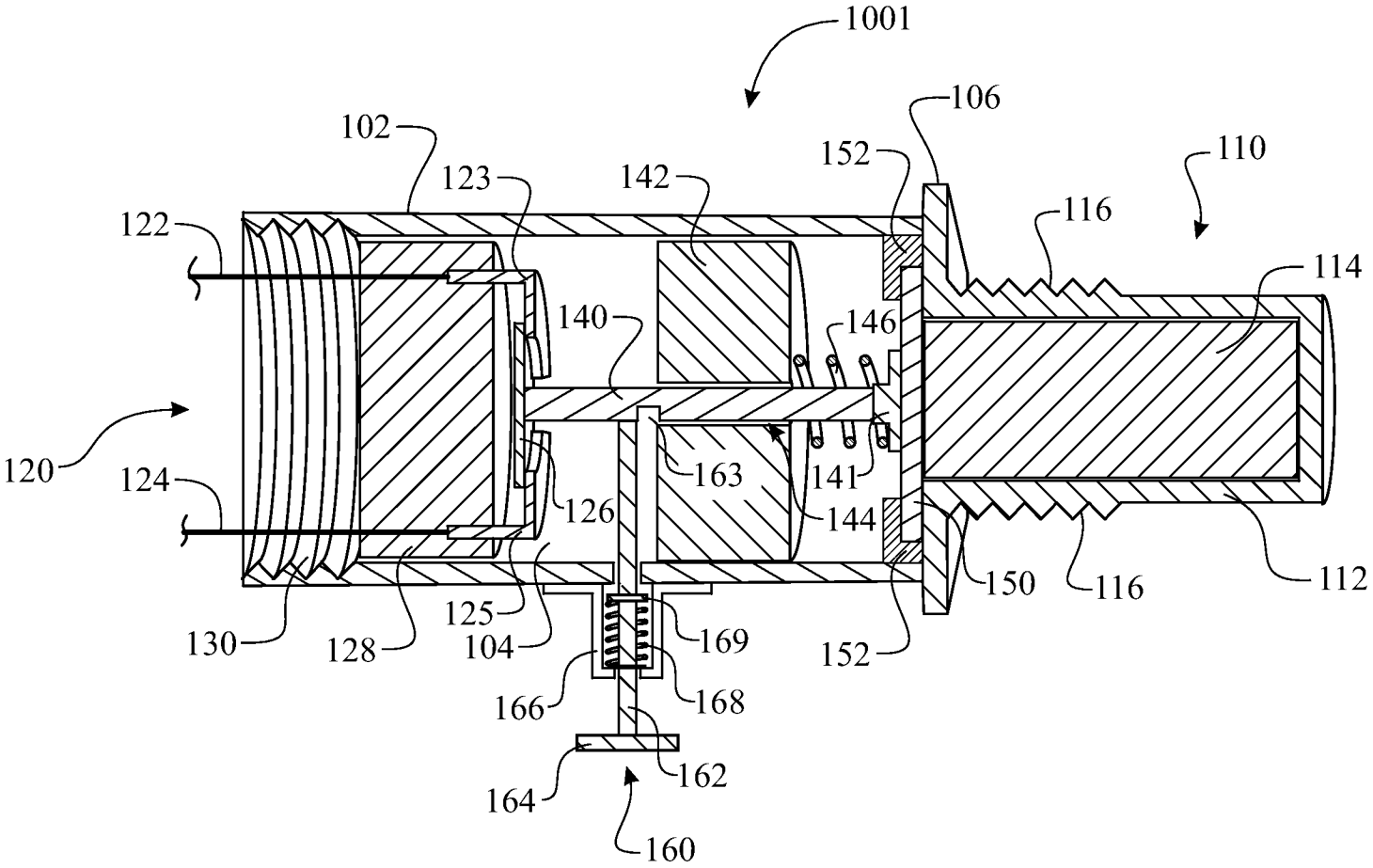
FIG. 5 is a sectioned elevation view of the thermally activated electrical interrupt switch as presented in FIG. 4 being sectioned along the central longitudinal axis, utilizing a thermally operated diaphragm interface with the switch shown in a closed circuit state.
Figure 6:
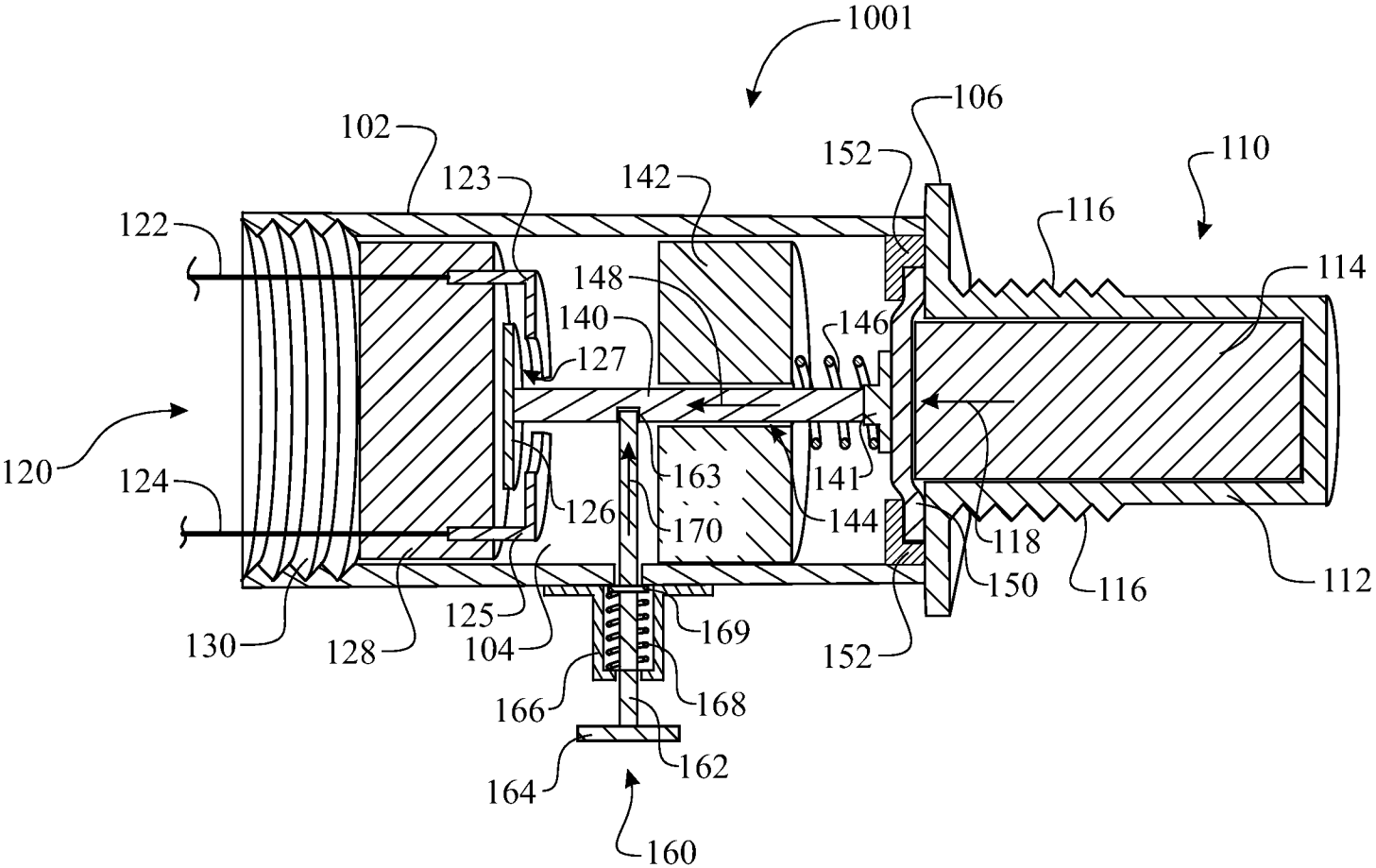
FIG. 6 is a sectioned elevation view of the thermally activated electrical interrupt switch as presented in FIG. 5 shown in a circuit interrupt state.
Figure 7:
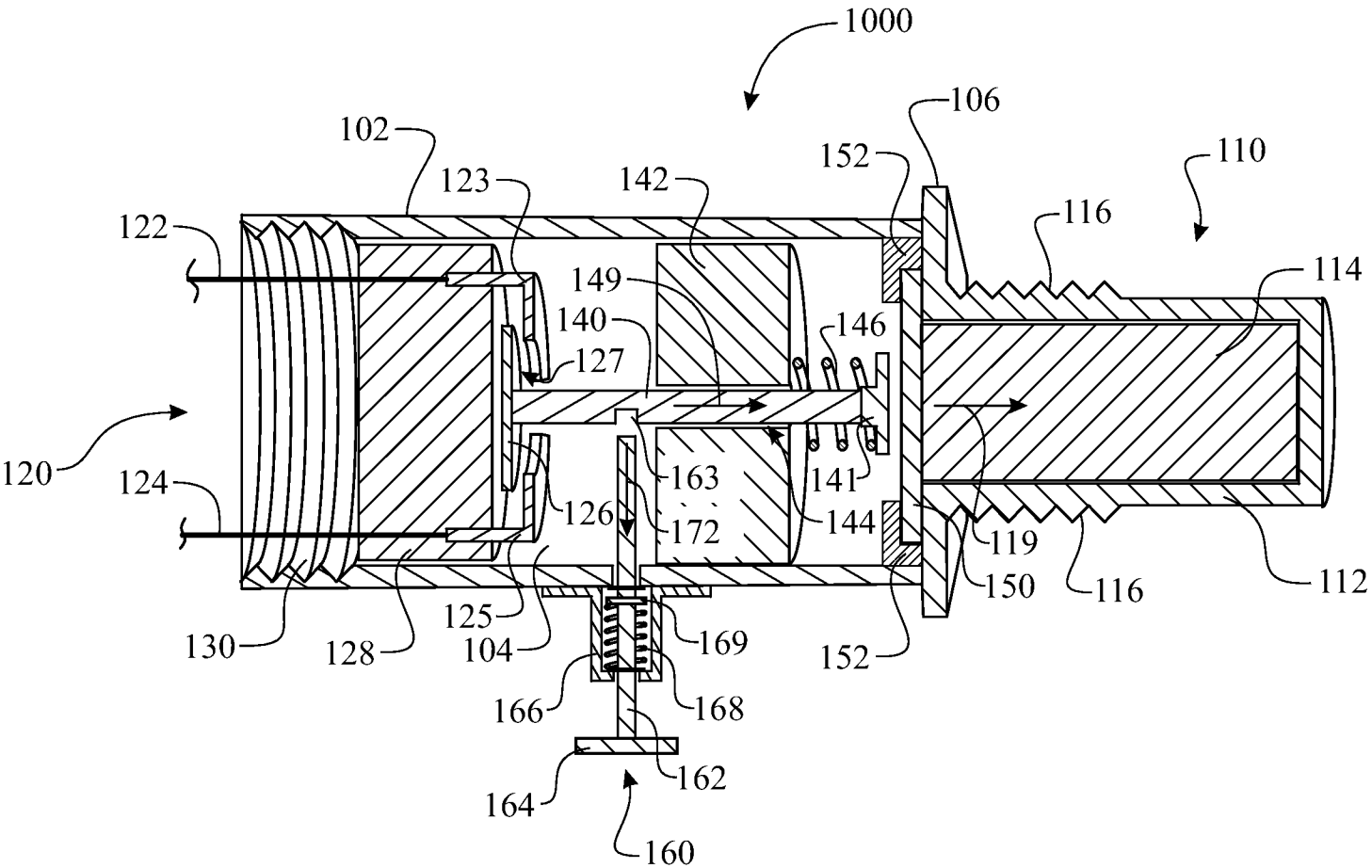
FIG. 7 is a sectioned elevation view of the thermally activated electrical interrupt switch incorporating a plunger contact configuration as presented in FIG. 5 shown in a circuit interrupt state.

A first exemplary embodiment of the reset mechanism 160 is presented in the sectional illustration of FIGS. 5 through 7. A reset engaging notch 163 is formed within the interrupt control rod 140. The reset engaging notch 163 is one example of a reset engaging feature, and can be a notch (as shown), a groove about the interrupt control rod 140, a flange, a projection from the rod, and the like. When the thermally expanding material 114 is heated, it generates an expansion force 118. The expansion force 118 expands the diaphragm 150, causing the interrupt control rod 140 to move in accordance with an interrupt generating motion 148. A reset spring 168 ensures the distal end of the reset control rod 162 remains in communication with the interrupt control rod 140. The reset spring 168 applies the engaging force against a reset spring retaining flange 169, which is affixed to the reset control rod 162. The motion of the interrupt control rod 140 repositions the reset engaging notch 163 until the distal end of the reset control rod 162 engages with reset engaging notch 163 via an inward reset rod motion 170. A contact separation 127 is created between the circuit controlling contact 126 and the terminals 123, 125 in concert with the engagement of the reset control rod 162 and the reset engaging notch 163. When the thermally expanding material 114 cools, the thermally expanding material 114 contracts potentially forming a gap between the control rod flange 141 and the diaphragm 150. The user resets the thermally activated electrical interrupt apparatus 1001 by pulling the reset button 164 away from the interrupt housing 102, causing the reset control rod 162 to move in accordance with an outward reset rod motion 172, thus disengaging the distal end of the reset control rod 162 and the reset engaging notch 163. The disengagement releases the interrupt control rod 140, which is returned (via a reset motion 149) to a ready state via a return force applied by the control rod return spring 146.

Figure 8:
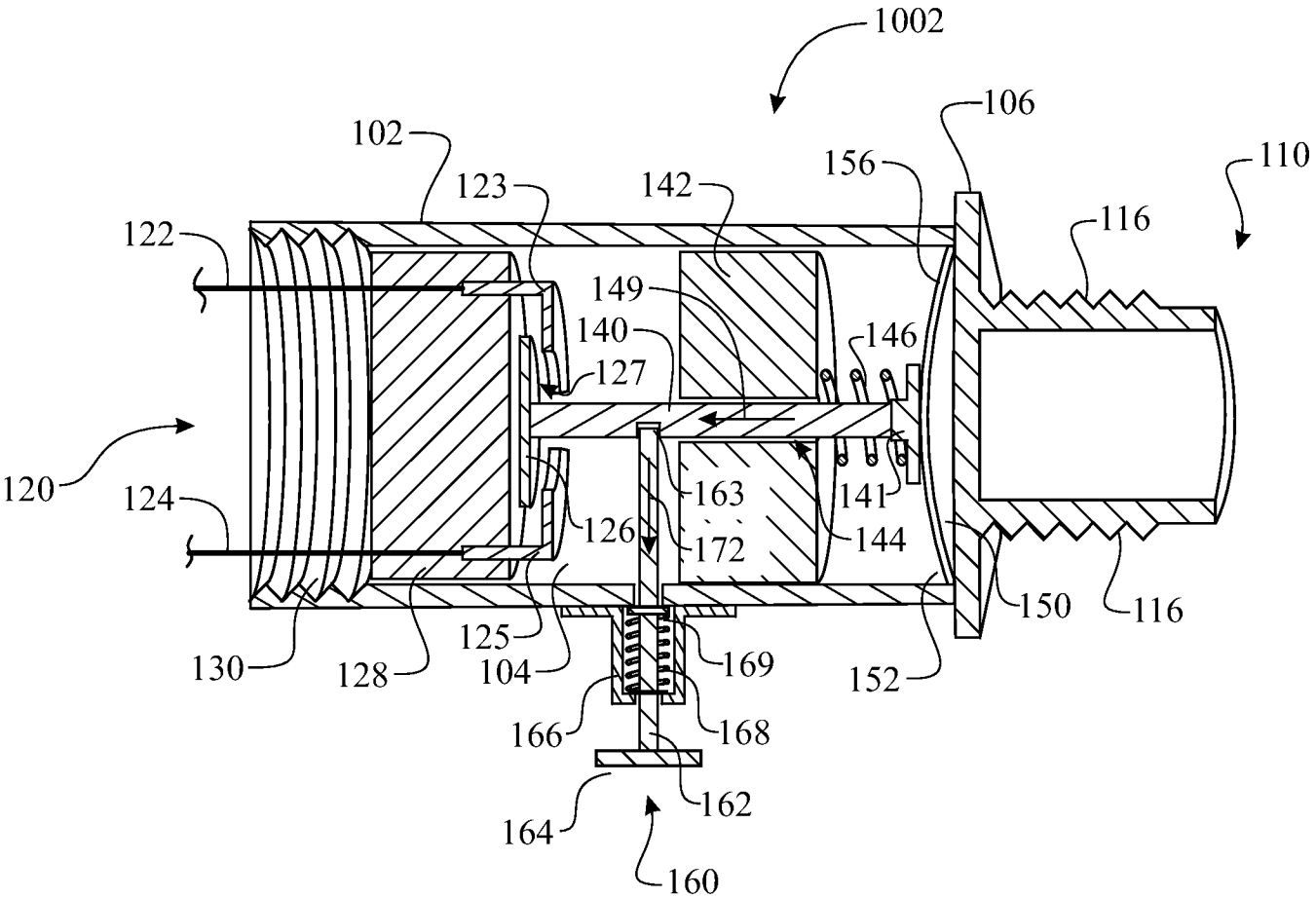
FIG. 8 is a sectioned elevation view of the thermally activated electrical interrupt switch incorporating a thermal expansion disc and a plunger contact configuration, shown in a circuit interrupt state.
Figure 9:
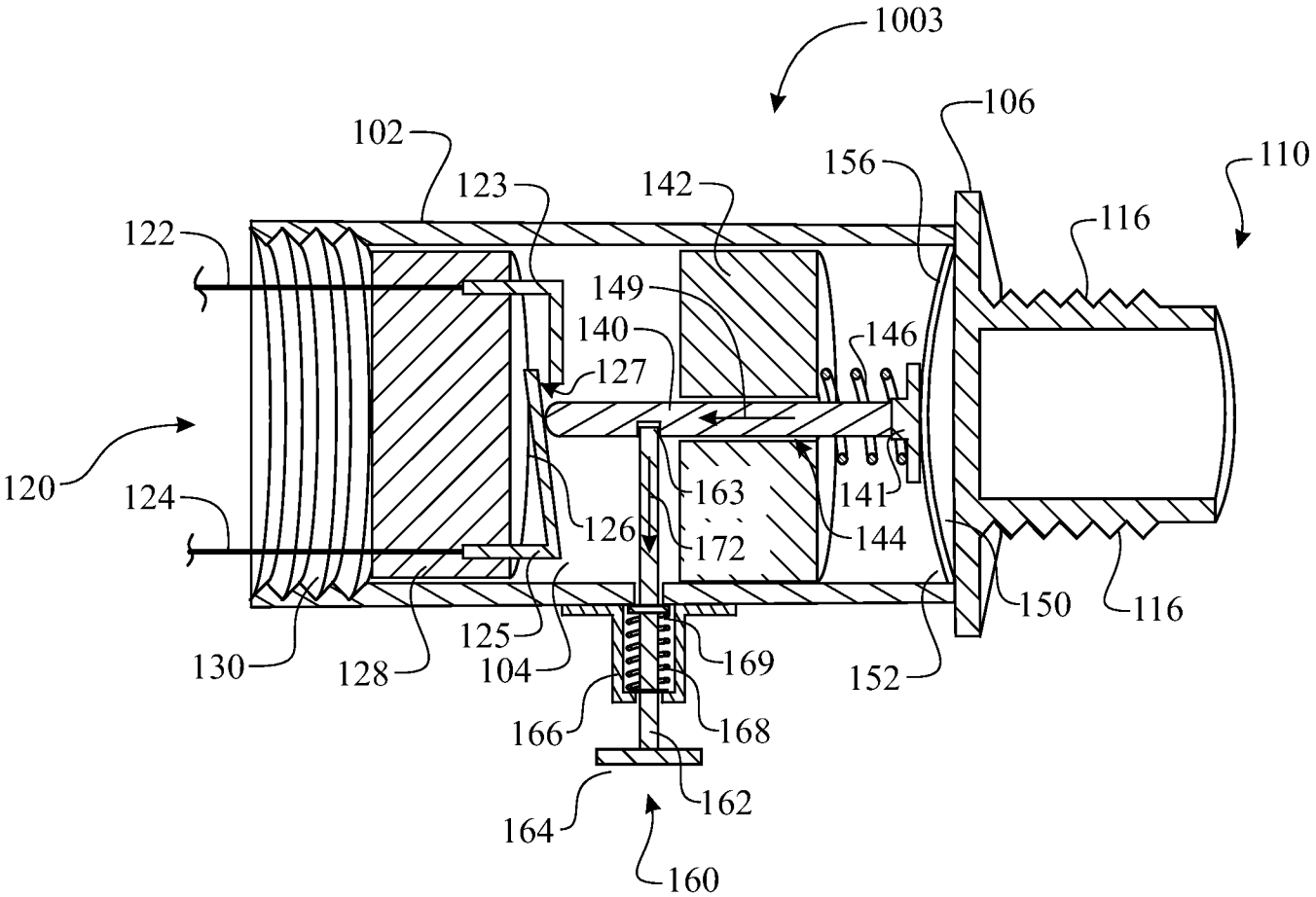
FIG. 9 is a sectioned elevation view of the thermally activated electrical interrupt switch incorporating a cantilevered contact configuration shown in a circuit interrupt state.

Several thermally activated electrical interrupt apparatuses 1002-1005 being variations of the thermally activated electrical interrupt apparatus 1000 and incorporating expansion discs 156 are presented in the sectional illustrations of FIGS. 8 through 11. The expansion disc 156 expands as it is heated, causing the interrupt control rod 140 to adjust accordingly. The motion of the interrupt control rod 140 changes the contact state of the electrical circuit contacts, as described in FIGS. 2 through 5. A plunger configuration is illustrated in FIG. 8. A cantilevered configuration is presented in FIG. 9. An alternately shaped interrupt control rod 140 is presented in FIGS. 10 and 11, removing the control rod flange 141, utilizing a spring force applied via either the cantilevered contact, between the circuit controlling contact 126 and the circuit mounting member 128, and the like.

Figure 12:
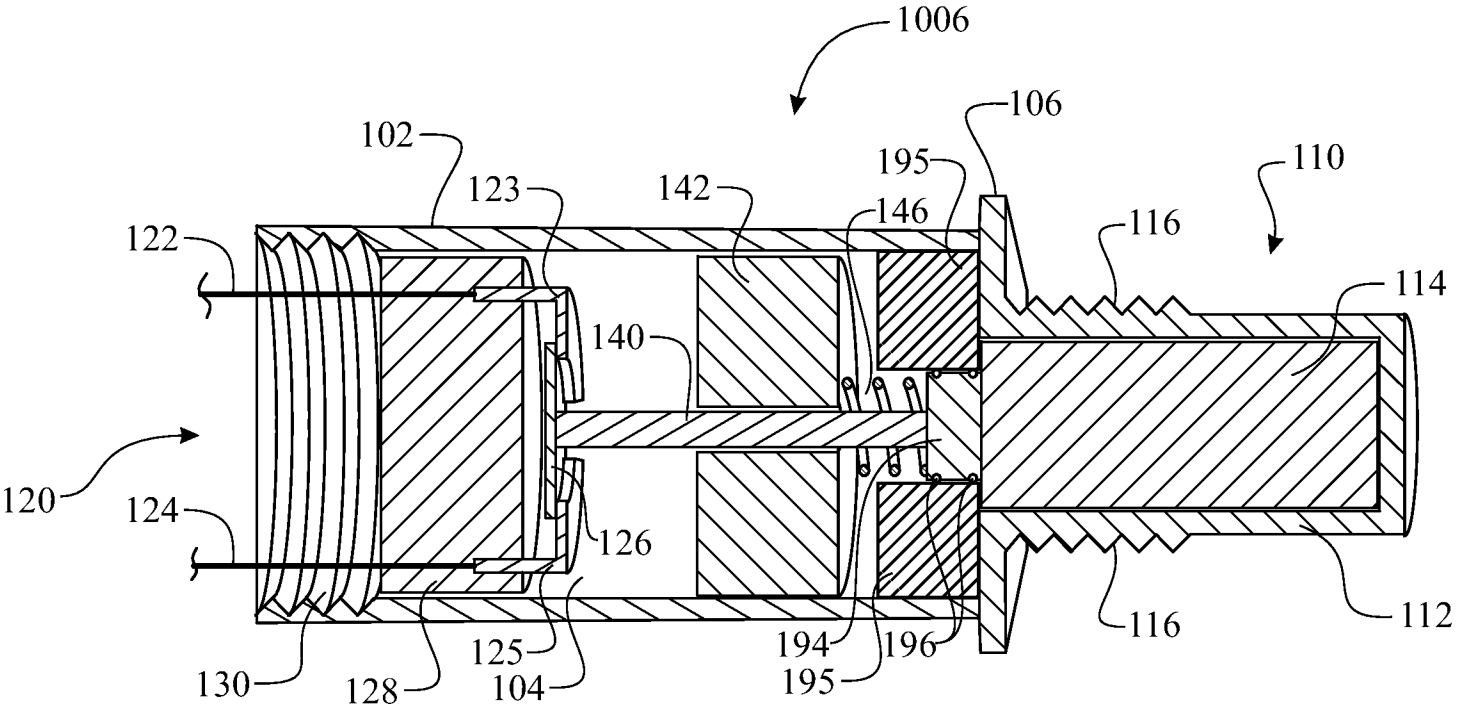
FIG. 12 is a sectioned elevation view of the thermally activated electrical interrupt switch utilizing a thermally operated piston interface with the switch shown in a closed circuit state.
Figure 13:
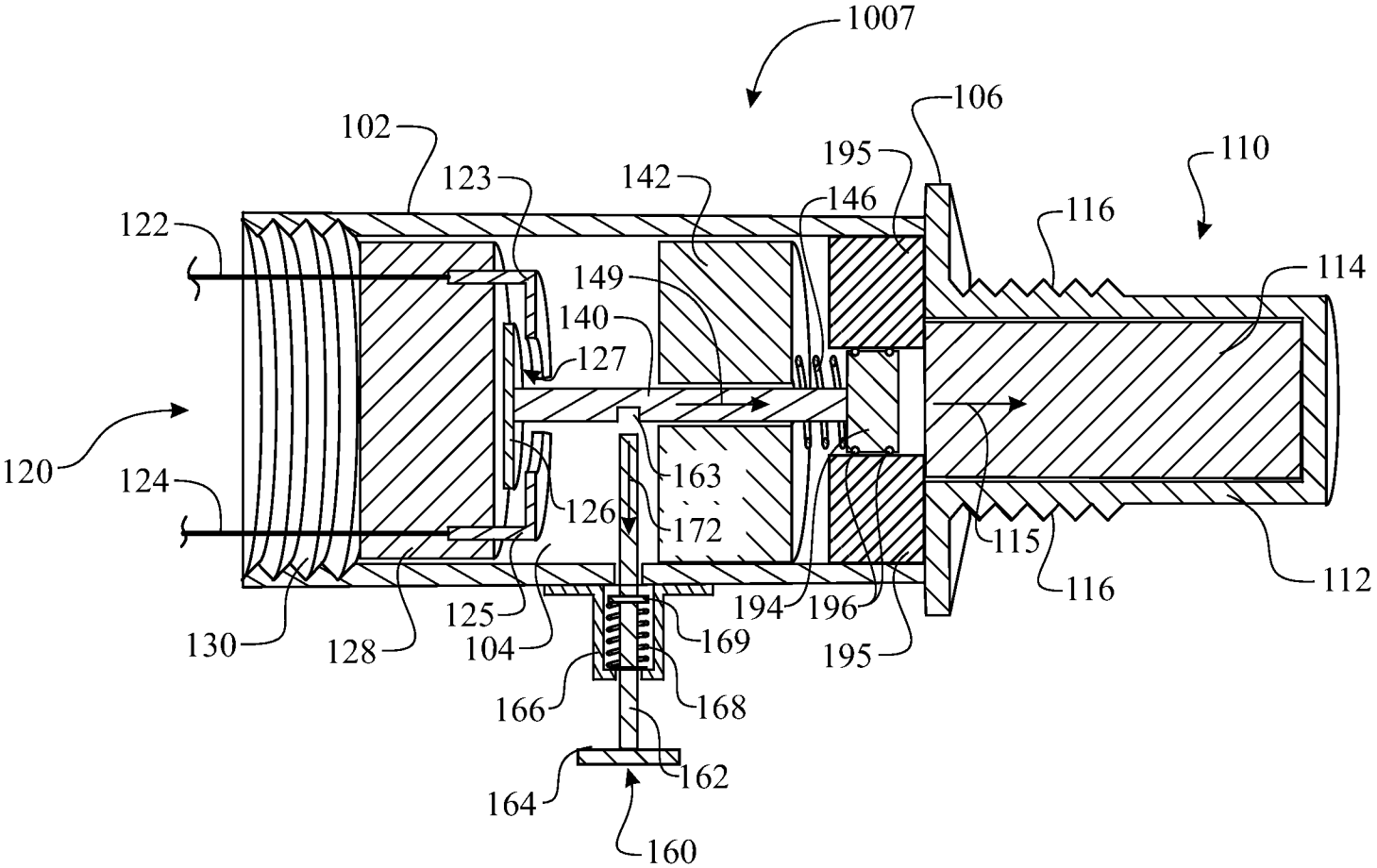
FIG. 13 is a sectioned elevation view of the thermally activated electrical interrupt switch utilizing a thermally operated piston interface incorporating a reset mechanism, with the switch shown in an interrupt state.

Another embodiment utilizes a piston interface (replacing the diaphragm interface previously presented) referenced as a thermally activated electrical interrupt apparatus 1006 illustrated in FIG. 12. An exemplary illustration of the thermally activated electrical interrupt apparatus 1006 introduces a piston 194 slideably contained within a piston sleeve 195. At least one piston seal 196 (two being shown) is assembled therein, forming a seal between the piston 194 and the piston sleeve 195. Alternate seal means can be utilized, including a rubber sleeve, a plastic sleeve, encapsulating the assembly, and any other piston design that is known by those skilled in the art. The piston assembly operates in a manner similar to the diaphragm system previously presented. The interrupt control rod 140 and the piston 194 can be independent or coupled. A reset mechanism 160 can be incorporated as illustrated in FIG. 13, functioning as previously presented in FIGS. 5 through 7.

Figure 14:
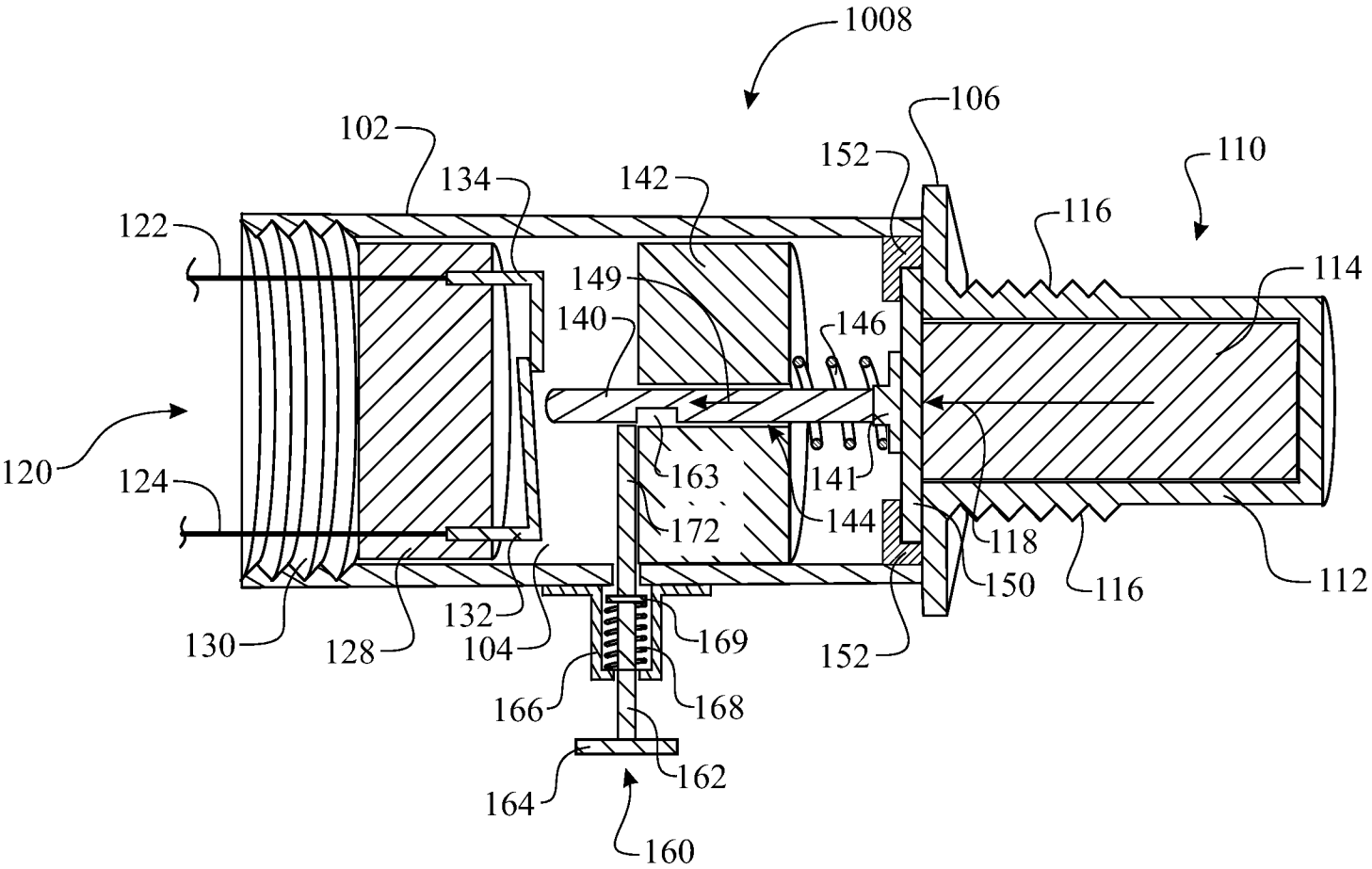
FIG. 14 is a sectioned elevation view of the thermally activated electrical interrupt switch utilizing a cantilevered contact configuration incorporating a reset mechanism, with the switch shown in a closed circuit state.
Figure 15:
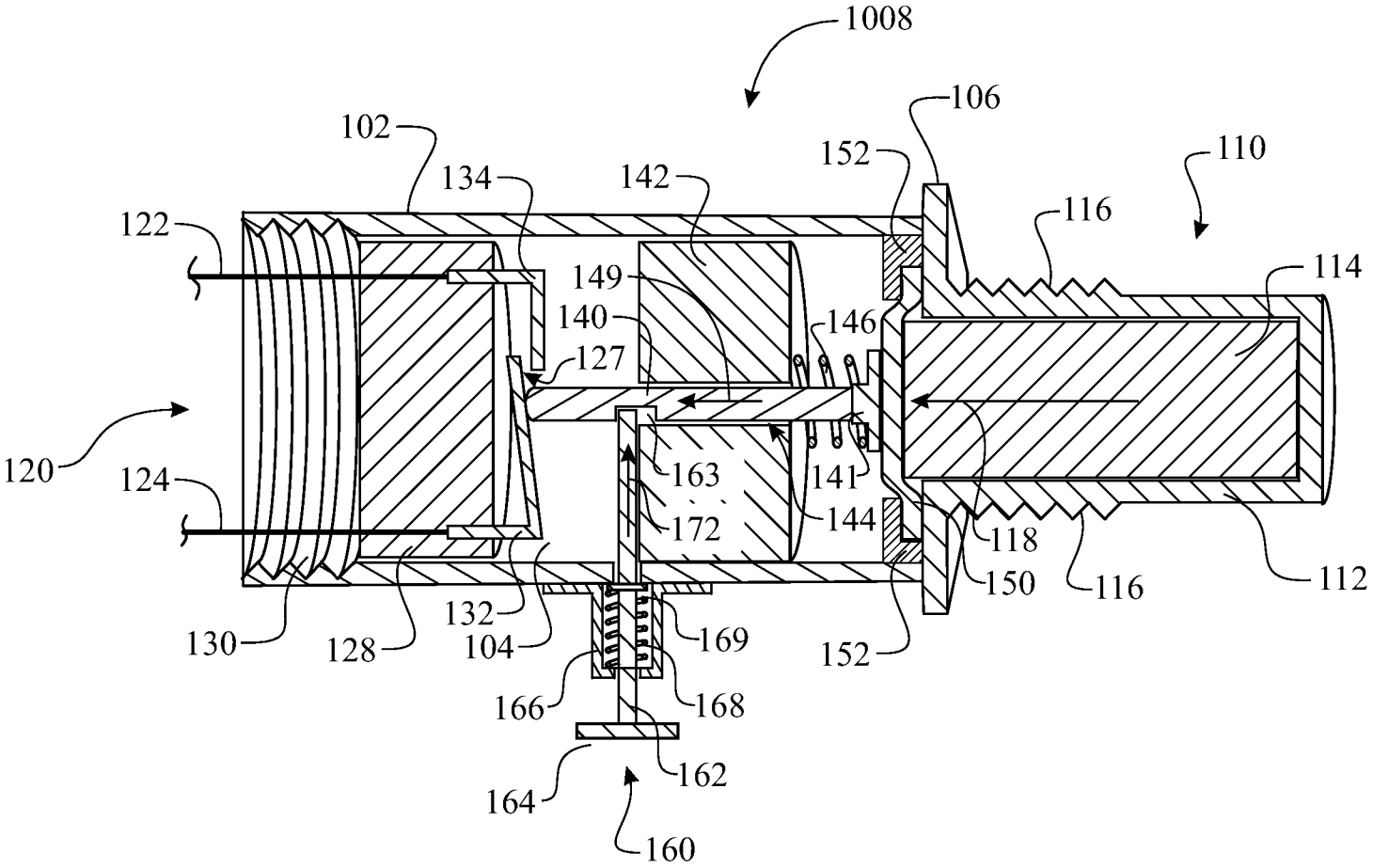
FIG. 15 is a sectioned elevation view of the thermally activated electrical interrupt switch as presented in FIG. 14 shown in an interrupt state.

While another exemplary embodiment, referred to as a thermally activated electrical interrupt apparatus 1008 illustrated in FIGS. 14 and 15 introduces an alternate electrical contact configuration and a slight variation on the reset mechanism 160. The alternate electrical contact configuration is a cantilevered design, utilizing a cantilevered contact 132 and a fixed contact 134. The fixed contact 134 separates from the cantilevered contact 132 via the reset motion 149 of the interrupt control rod 140, causing the contact separation 127. The illustration shows an adjusted position of the reset mechanism 160, placing the reset control rod 162 adjacent the edge of the control rod bushing 142.

Figure 16:
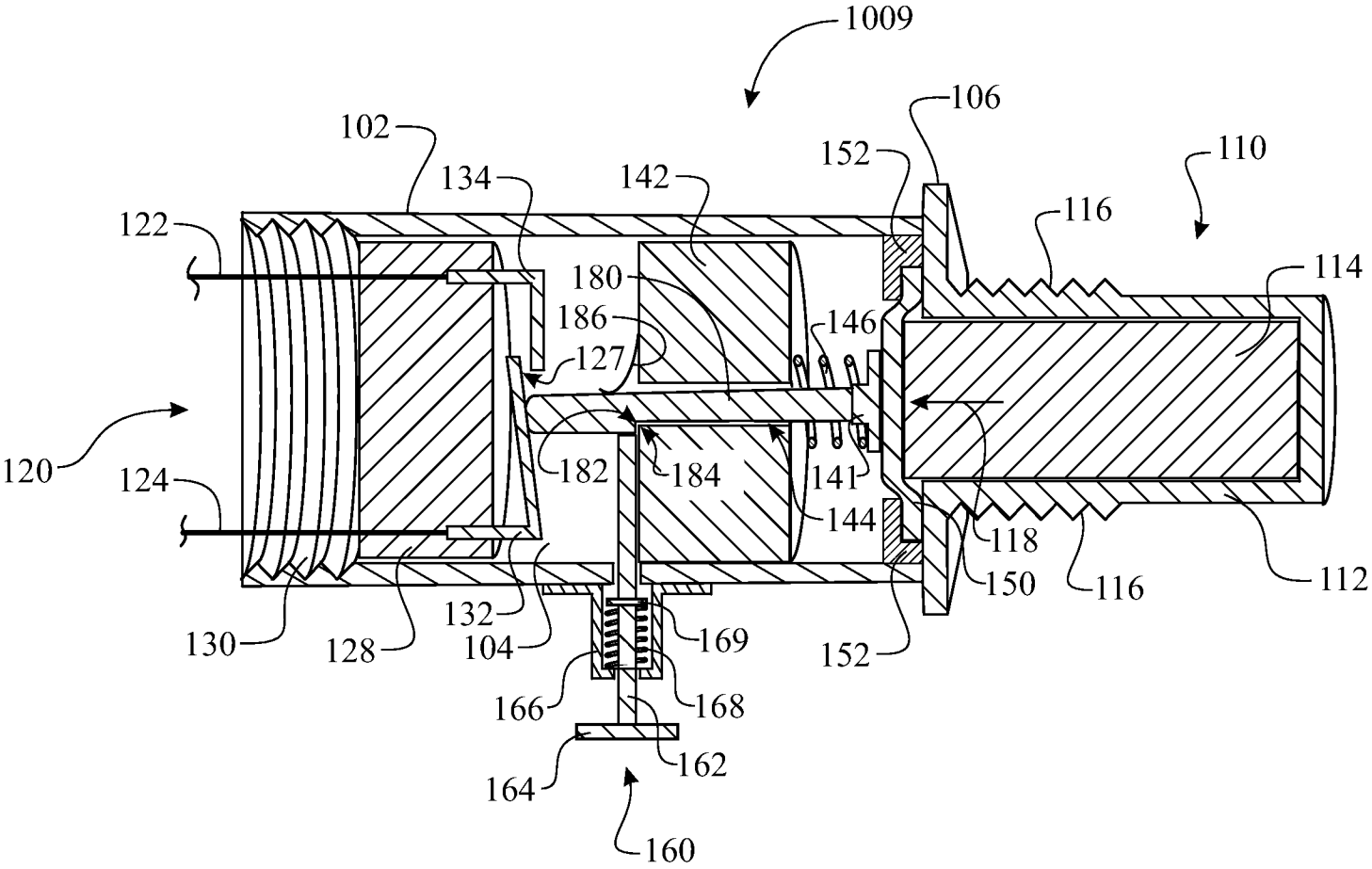
FIG. 16 is a sectioned elevation view of the thermally activated electrical interrupt switch utilizing a notched latching configuration, with the switch shown in an interrupt state.
Figure 17:
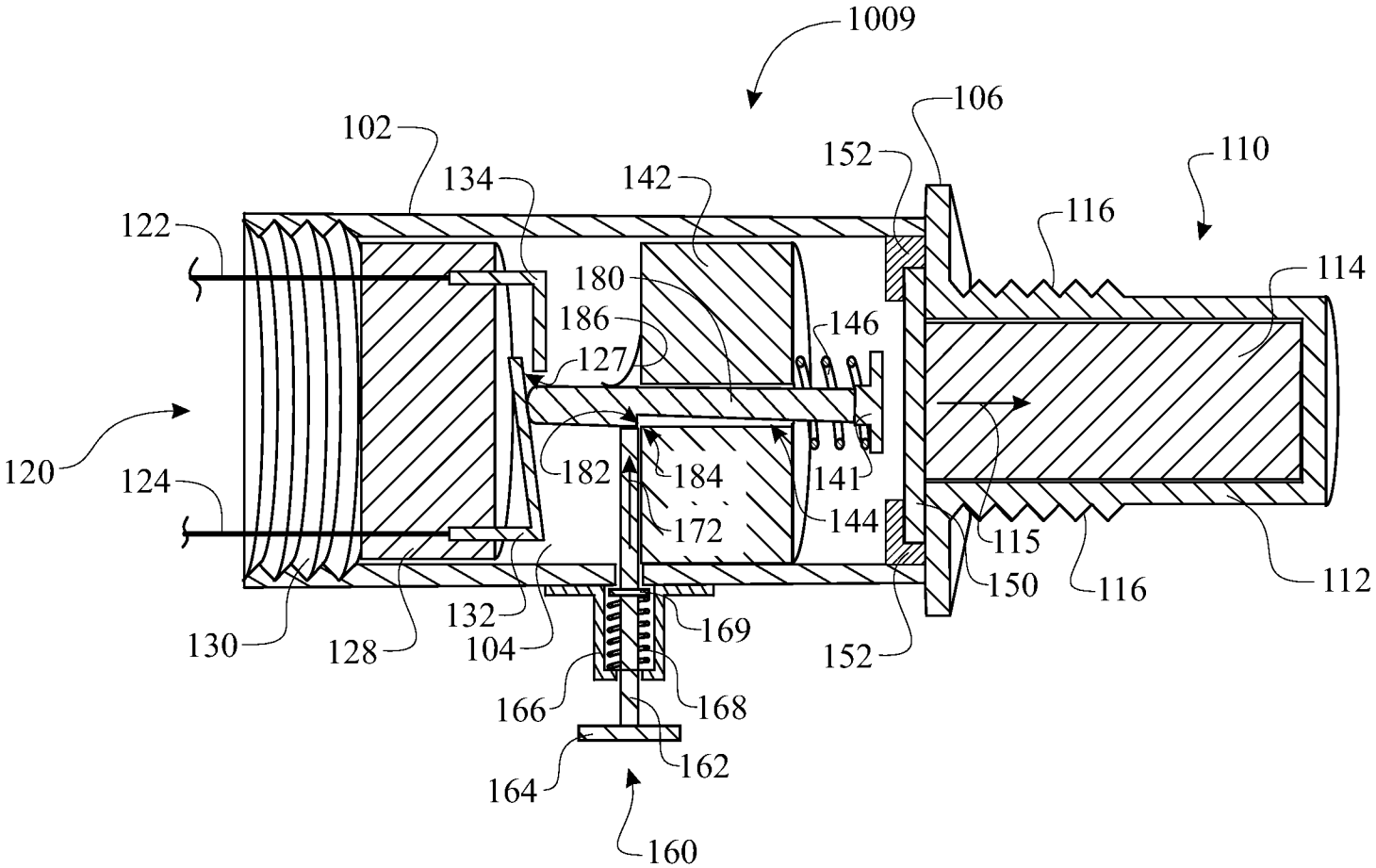
FIG. 17 is a sectioned elevation view of the thermally activated electrical interrupt switch as presented in FIG. 14 showing the reset mechanism activated and the thermal activated material in a cooled state.
Figure 18:
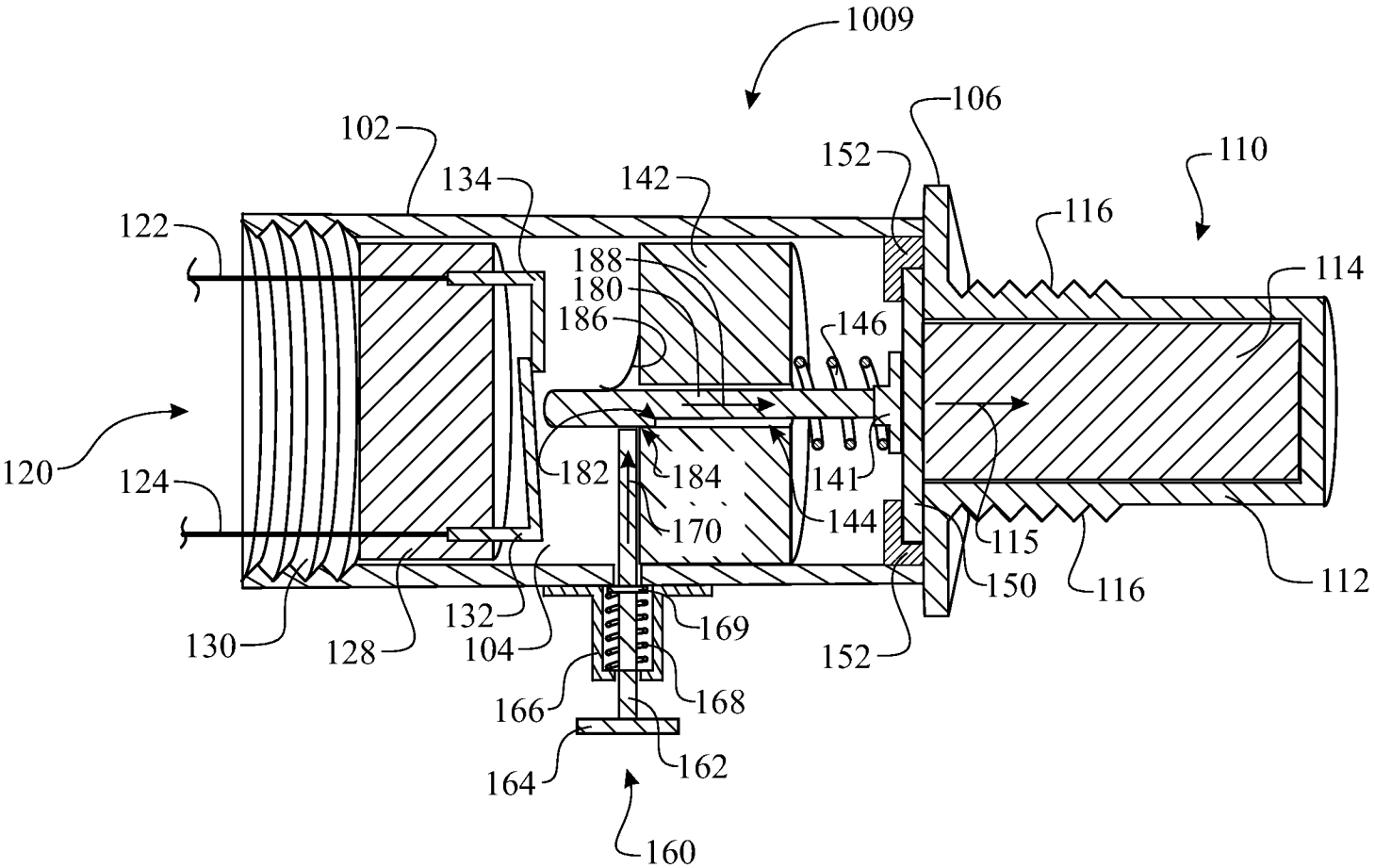
FIG. 18 is a sectioned elevation view of the thermally activated electrical interrupt switch as presented in FIG. 17 shown in a reset state.

With yet another exemplary embodiment, referred to as a thermally activated electrical interrupt apparatus 1009 illustrated in FIG. 16 through 18 introduces an alternate latching configuration for the reset mechanism, wherein an offset notched interrupt rod 180 includes an offset notch 182 which engages with a bushing reset interface 184 of the control rod bushing 142. An engaging spring 186 rides along the offset notched interrupt rod 180 on a side opposing the offset notch 182, providing a downward force to the offset notched interrupt rod 180, ensuring the offset notch 182 engages with the bushing reset interface 184. As the thermally expanding material 114 cools, the material shrinks. The diaphragm 150 causes the shrinking thermally expanding material 114 to move in accordance with a contracting motion 115. The rod 180 remains engaged with the bushing reset interface 184 until reset by the reset mechanism 160. The offset notch 182 disengages from the bushing reset interface 184 via an inward reset rod motion 170 of the reset control rod 162, then returns to a monitoring state via an interrupt rod reset motion 188.

Figure 19:
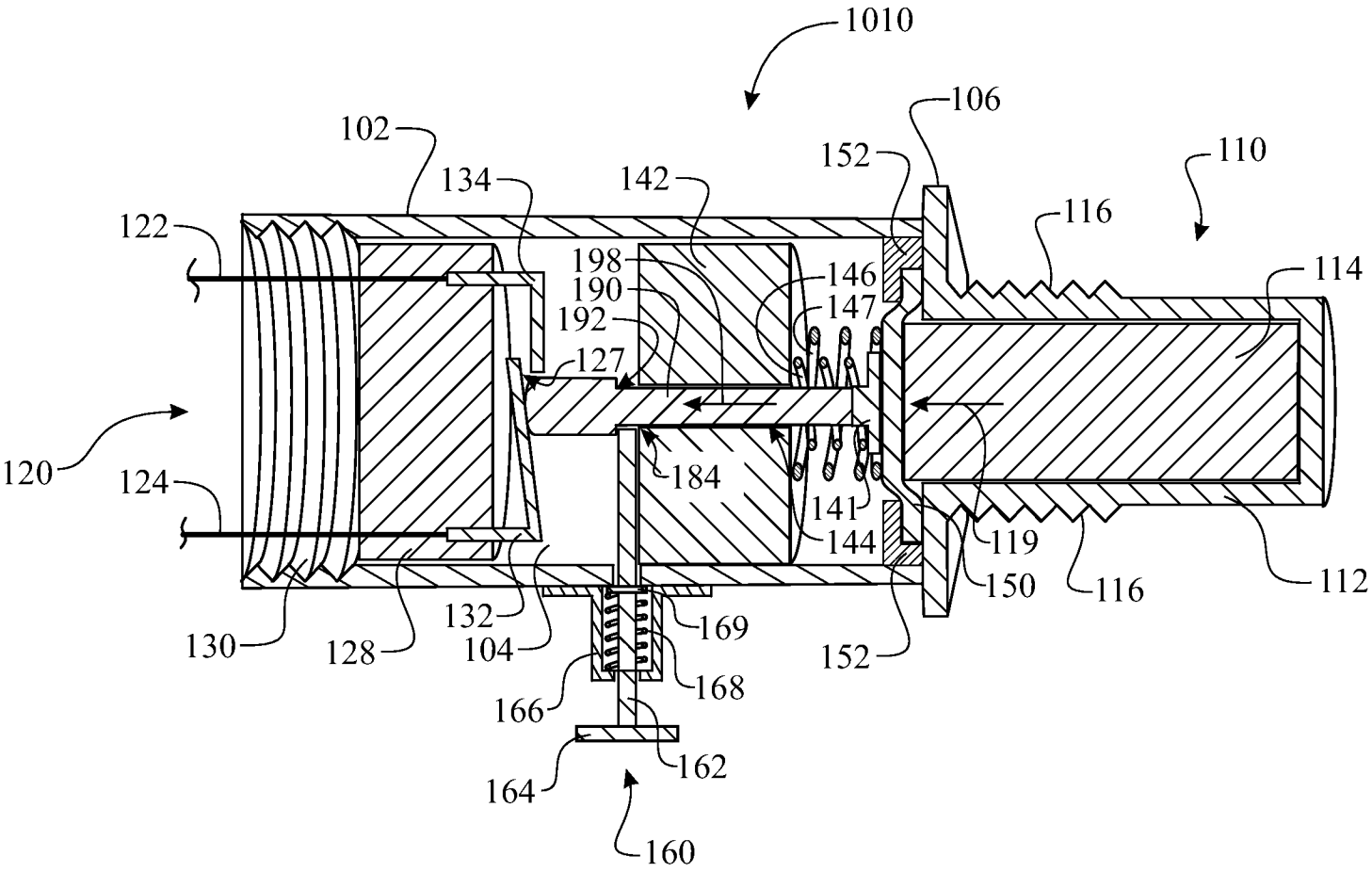
FIG. 19 is a sectioned elevation view of the thermally activated electrical interrupt switch utilizing a stepped interrupt control rod configuration, with the switch shown in an interrupt state.
Figure 20:
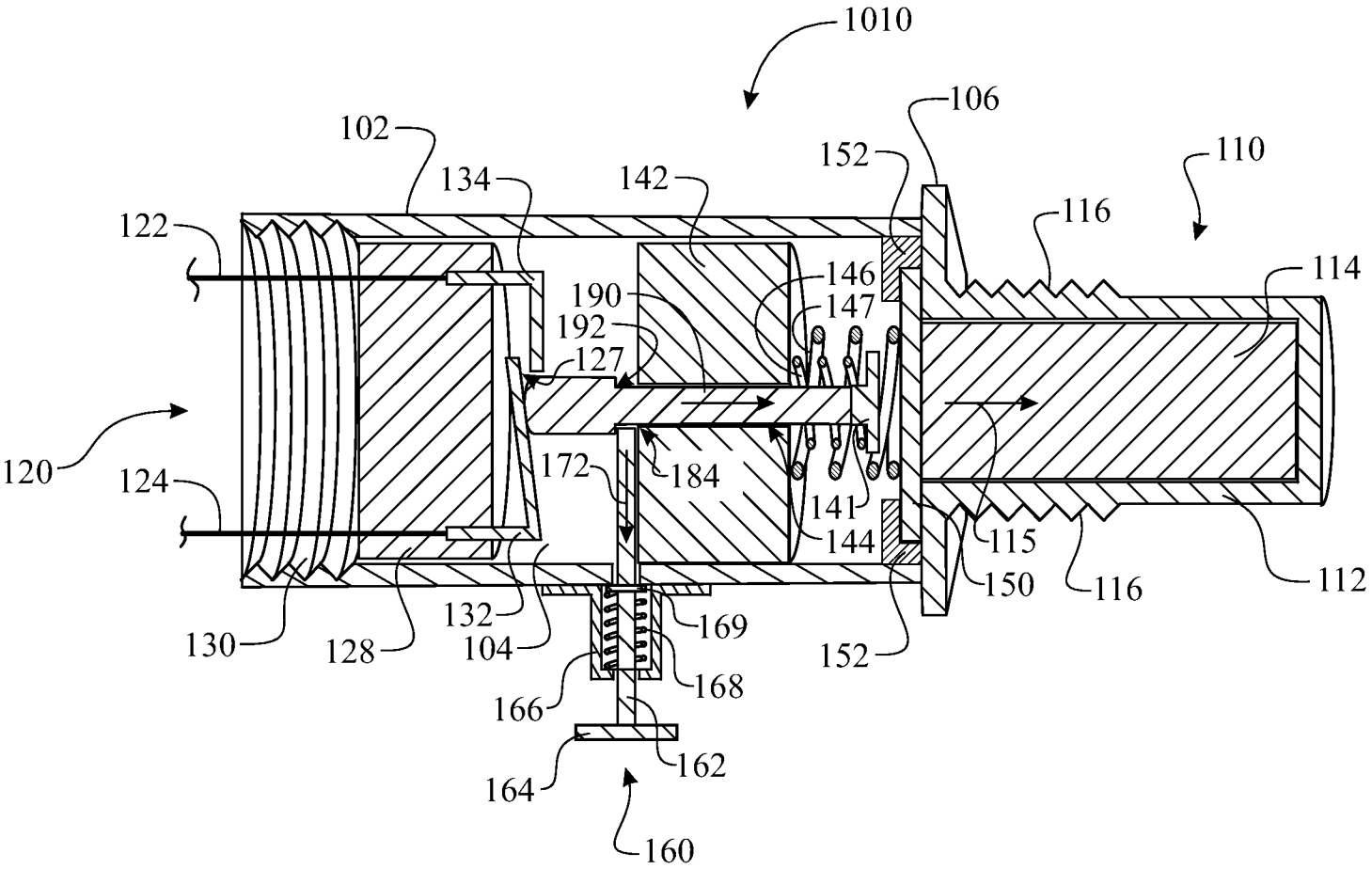
FIG. 20 is a sectioned elevation view of the thermally activated electrical interrupt switch as presented in FIG. 19 showing the reset mechanism activated and the thermal activated material in a cooled state.
Figure 21:
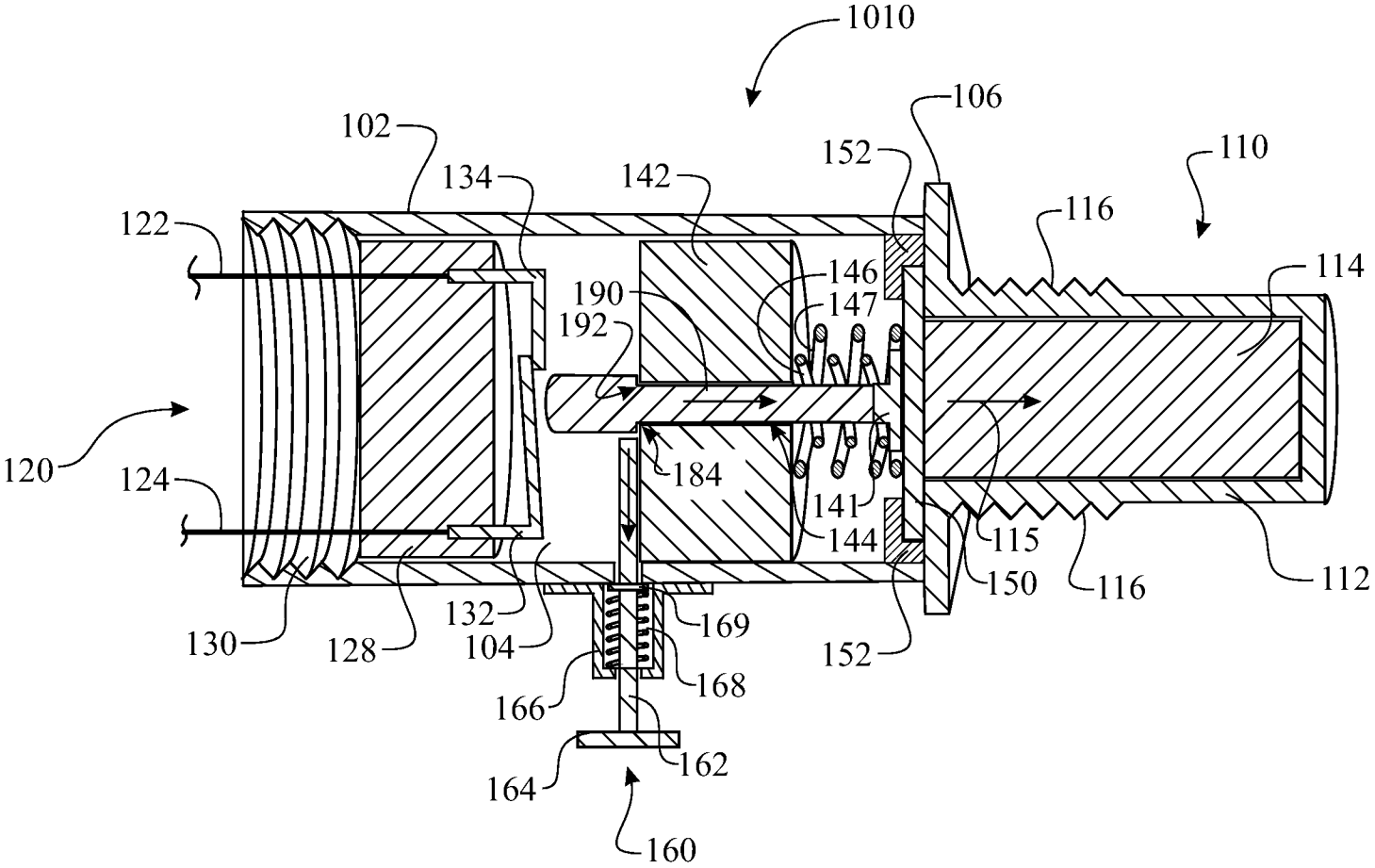
FIG. 21 is a sectioned elevation view of the thermally activated electrical interrupt switch as presented in FIG. 19 shown in a reset state.

With another exemplary embodiment, referred to as a thermally activated electrical interrupt apparatus 1010 illustrated in FIG. 19 through 21 introduces yet another alternate latching configuration for the reset mechanism, wherein a multi-diameter interrupt control rod 190 includes an interrupt control rod notch 192 which engages with a bushing reset interface 184 of the control rod bushing 142. The multi-diameter interrupt control rod 190 is fabricated having two sections: a sliding shaft size diameter placed within the rod passage 144, and a larger activation diameter, with an interrupt control rod notch 192 at the transition between the two diameters. When the thermally expanding material 114 is heated, the multi-diameter interrupt control rod 190 moves via a control rod interrupt motion 198 and the interrupt control rod notch 192 of the multi-diameter interrupt control rod 190 engages with the distal end of the reset control rod 162 creating an open circuit between the two contacts 132, 134. The open circuit interrupts power to the motor or pump, allowing it to cool. As the motor cools, the thermally expanding material 114 cools, thus contracting. A thermal material return spring 147 is positioned between a wall of the control rod bushing 142 and the diaphragm collar 152, compressing the diaphragm 150 as the thermally expanding material 114 contracts. A gap is created between the diaphragm 150 and the control rod flange 141 of the multi-diameter interrupt control rod 190. Once in an interrupt state, the user can pull the reset button 164, causing an outward reset rod motion 172 of the reset control rod 162. When the distal end of the reset control rod 162 is removed from the interrupt control rod notch 192, the multi-diameter interrupt control rod 190 is returned (via a control rod return spring 146) to a monitoring state by a return force applied by the control rod return spring 146.

Figure 22:
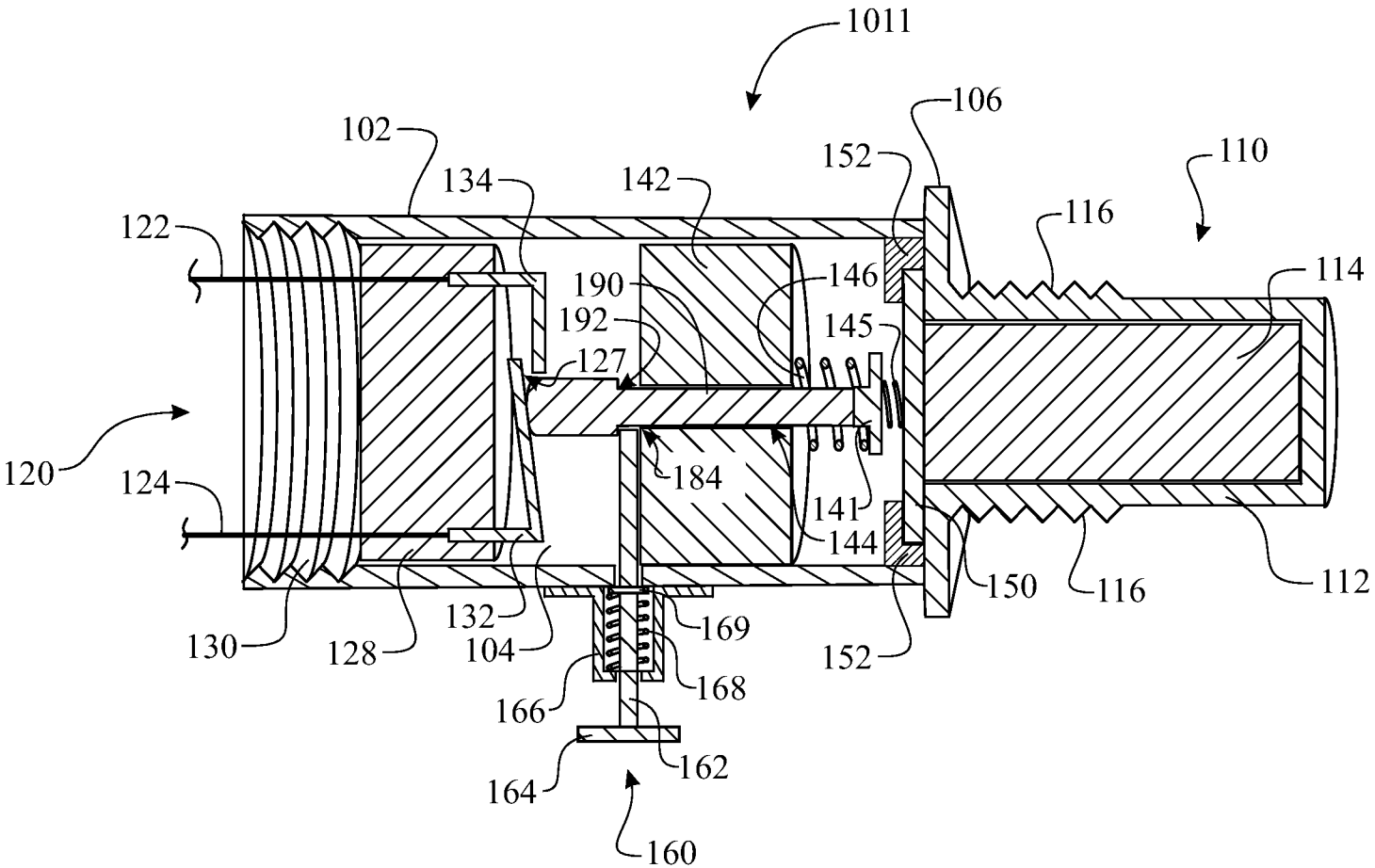
FIG. 22 is a sectioned elevation view of the thermally activated electrical interrupt switch illustrating an alternate interrupt rod return spring configuration.

An alternate to the configuration shown in FIGS. 19 through 21 utilizes a thermal material return spring 145 placed between the control rod flange 141 of the control rod (control rod 190 is presented as an exemplary embodiment, whereas it is recognized that any control rod can be used) and the diaphragm 150, as presented in thermally activated electrical interrupt apparatus 1011 of FIG. 22. It is recognized that any of the various configurations for ensuring the expansion portion of the thermally activated electrical interrupt apparatus 1000 returns to a contracted state.

Figure 23:
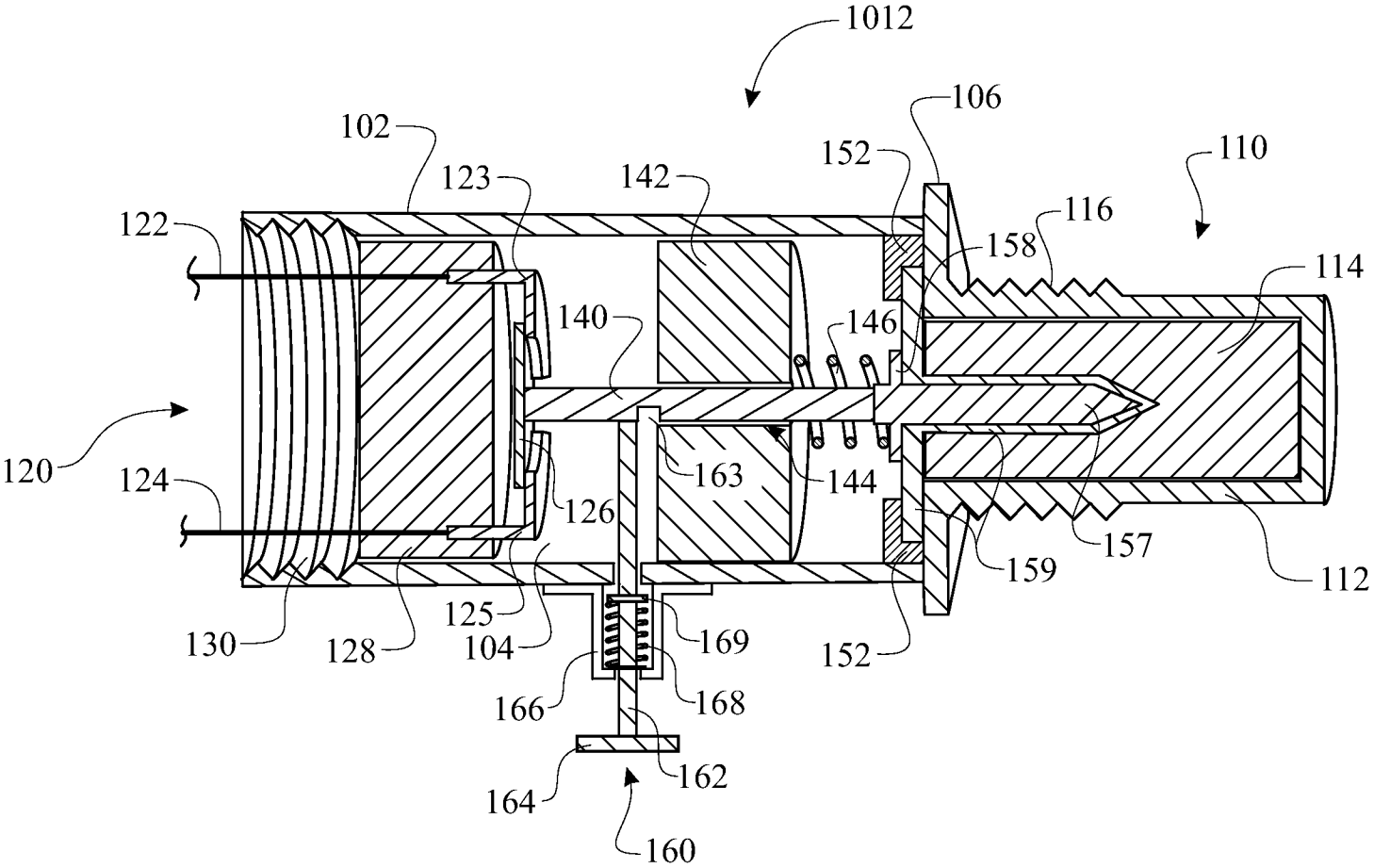
FIG. 23 is a sectioned elevation view of the thermally activated electrical interrupt switch illustrating an alternate diaphragm/piston interface configuration.

A hybrid thermal interface configuration is presented as a thermally activated electrical interrupt apparatus 1012 of FIG. 23. The hybrid configuration incorporates a formed diaphragm 159 having a protrusion that displaces thermally expanding material 114 within the thermal transfer housing portion 112. The control rod 157 is formed including an elongated portion, which contours to the protrusion of the formed diaphragm 159. The control rod 157 can optionally include a control rod flange 158, engaging with a control rod return spring 146 ensuring the control rod 157 returns to a monitoring state. It is recognized other configurations can be utilized without deviating from the spirit and intent of the present invention. The interrupt control rod 140 can be joined or independent of the control rod flange 158. The control rod return spring 146 engages the circuit controlling contact 126 against the contact terminals 123, 125 in the joined configuration. A spring (such as spring 136 shown in FIG. 10) can be inserted between the circuit controlling contact 126 and the respective face of the circuit mounting member 128 in the independent configuration.

Several variations of a thermal motion conveyance mechanism have been described in detail herein, one using a diaphragm 150, another using a multi-diameter interrupt control rod 190, and yet another using a hybrid configuration. It is recognized that other thermal expanding configurations such as a thermal expansion disc can be utilized for the thermally activated portion of the thermally activated electrical interrupt apparatus 1000. The Inventor additionally discloses a design wherein the expanding section of the thermal housing can be necked down or tapered, thus, increasing the expanding distance over the same temperature range. Essentially, the smaller the diameter of the thermally expanding material section at the diaphragm or piston location, the larger the distance the control rod travels.

Two contact designs have been shown herein. It is recognized other contact designs, which are controlled via a control rod, can be utilized maintaining the spirit and intent of the present invention.

The reset mechanism 160 depicted herein is manually operated. Those skilled in the art can automate the reset mechanism 160, including a provision for documenting each interrupt cycle. Additionally, an alarm circuit can be automated to include a notification process, such as a delivery of a text message, voice message, email, and the like.

Figure 24:
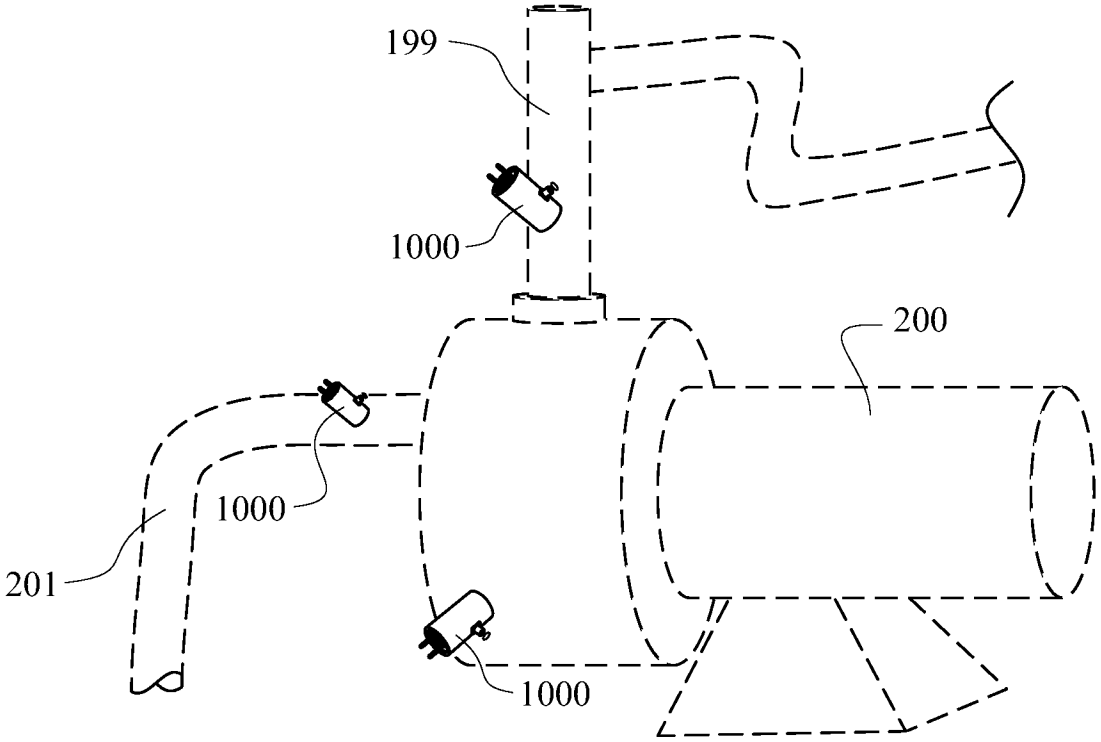
FIG. 24 is an isometric view illustrating an exemplary application of the thermally activated electrical interrupt switch.

An exemplary application of the thermally activated electrical interrupt apparatus 1000 is presented in FIG. 24. The thermally activated electrical interrupt apparatus 1000 is inserted into either an inlet piping 199, an exit piping 201, or a section of the pump 200. The electrical outputs 122, 124 (FIG. 1) would be connected in series to the operating power control circuit, a control circuit, or any other desired circuit in communication with the pump 200. Where a plurality of interrupt devices 1000 is used, they would be placed in series or as prescribed by the user. It is understood the thermally activated electrical interrupt apparatus 1000 can be installed on other devices such as motors, bearings, and the like.

Figure 25:
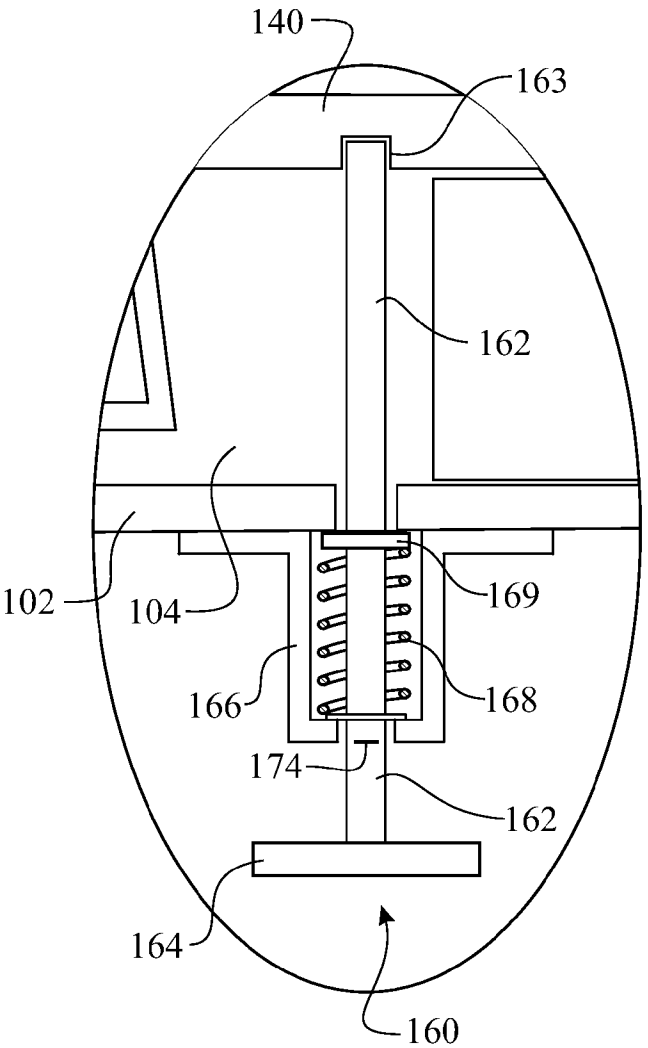
FIG. 25 is an enlarged sectional view of a plunger reset configuration introducing a status marker, presented in a circuit interrupt state.
Figure 26:
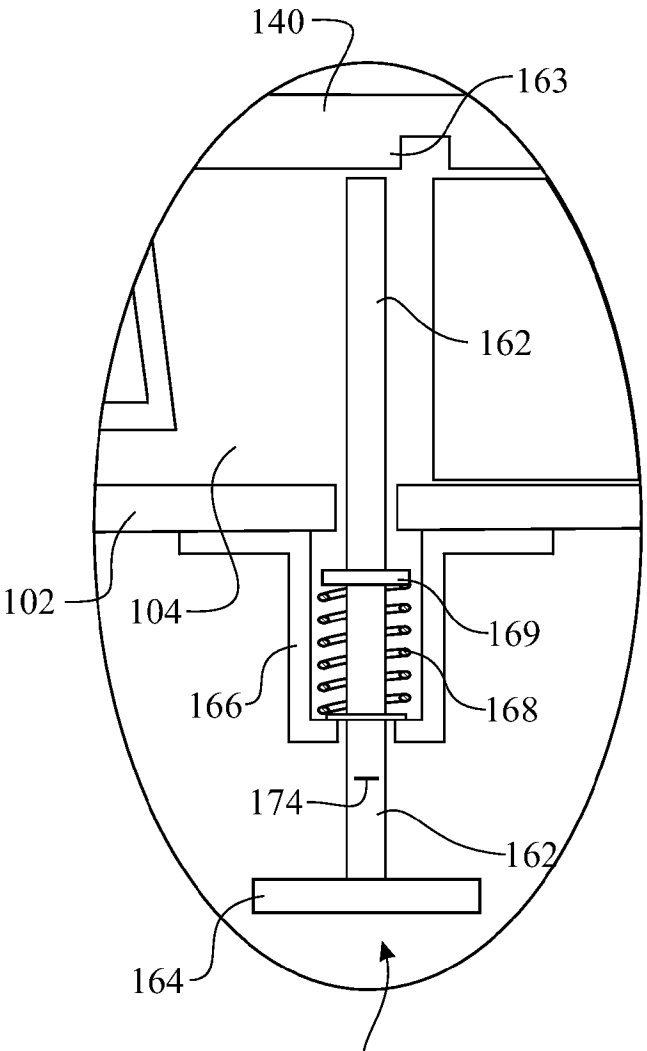
FIG. 26 is an enlarged sectional view of a plunger reset configuration introducing a status marker, presented in a closed circuit state.

The reset mechanism 160 can include a reset status marker 174 as illustrated in FIGS. 25 and 26. The reset status marker 174 is preferably aligned with a feature on the reset mechanism housing 166, such as the end as shown, when the thermally activated electrical interrupt apparatus 1000 is in a circuit interrupt state (FIG. 25). When the thermally activated electrical interrupt apparatus 1000 is reset, the service person pulls the reset button 164 away from the interrupt control rod 140, allowing the interrupt control rod 140 to return to the closed circuit state (FIG. 26). The engaging end of the reset control rod 162 then rides against the edge of the interrupt control rod 140, positioning the reset status marker 174 distant from the edge of the reset mechanism housing 166 indicating the thermally activated electrical interrupt apparatus 1000 is in an operational or closed circuit state.

Figure 27:
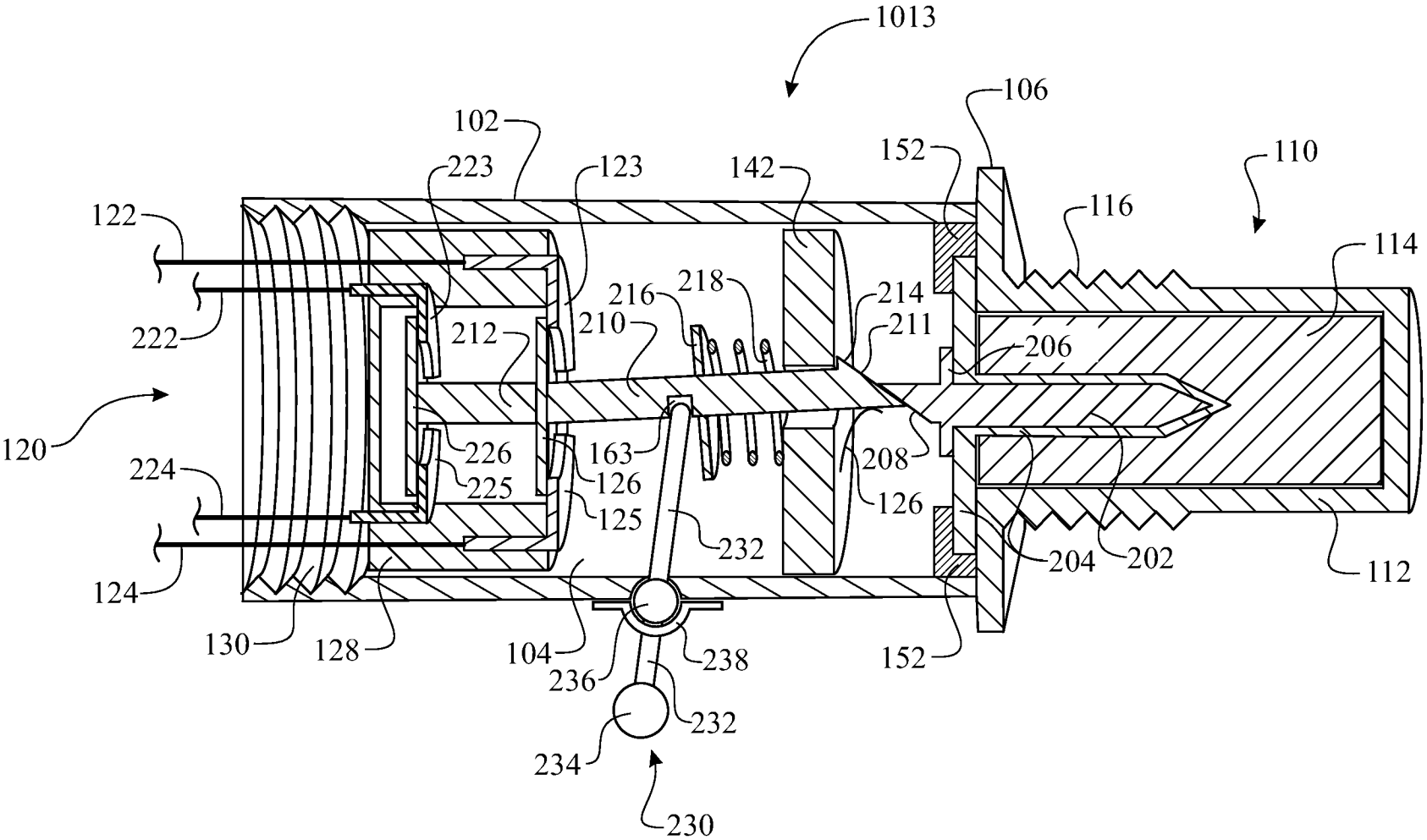
FIG. 27 is a sectioned elevation view of the thermally activated electrical interrupt switch illustrating an alternate circuit actuation configuration, a dual electrical connection, and a pivotal reset configuration, presented in a closed circuit state.
Figure 28:
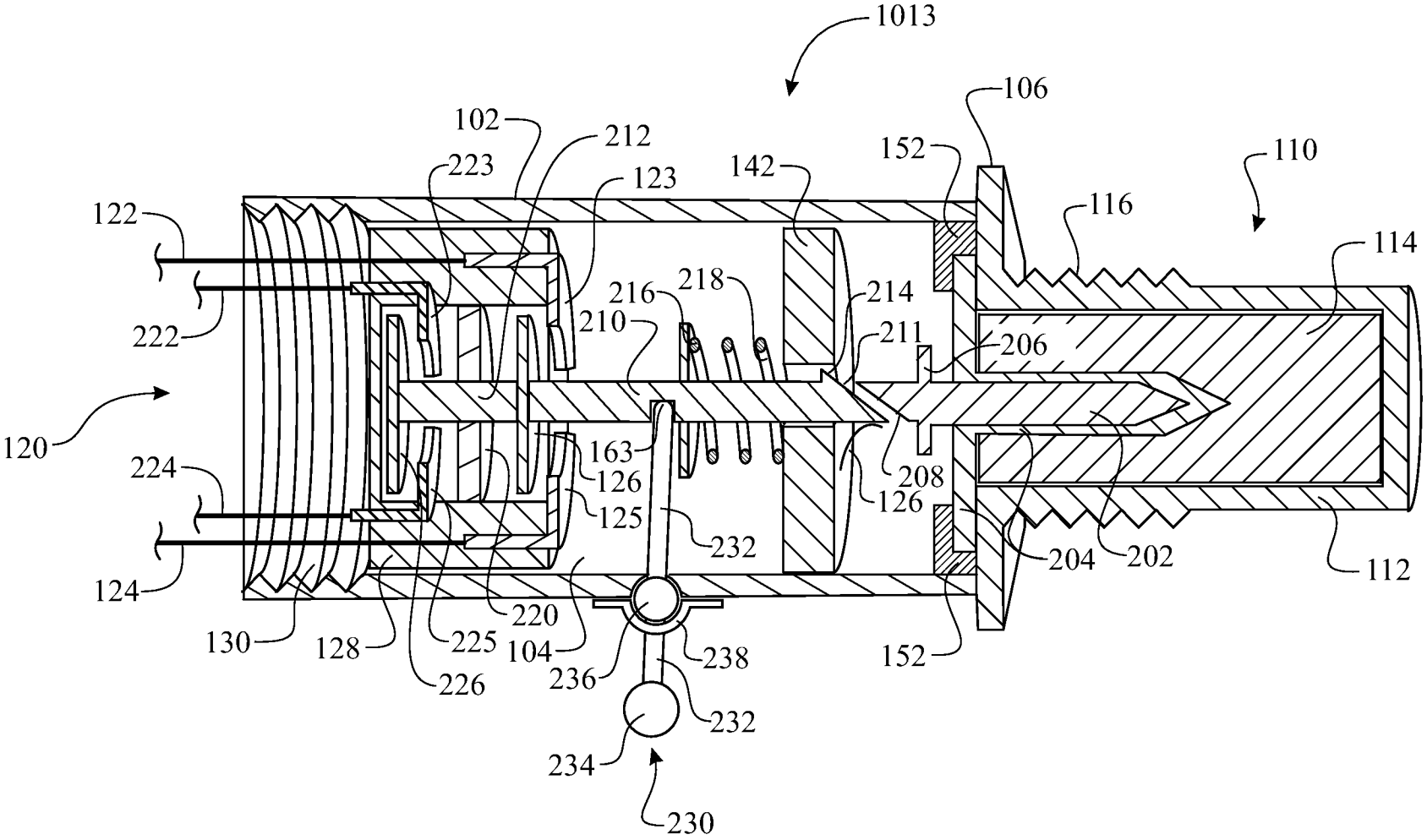
FIG. 28 is a sectioned elevation view of the thermally activated electrical interrupt switch of FIG. 27, presented in a circuit interrupt state.
Figure 29:
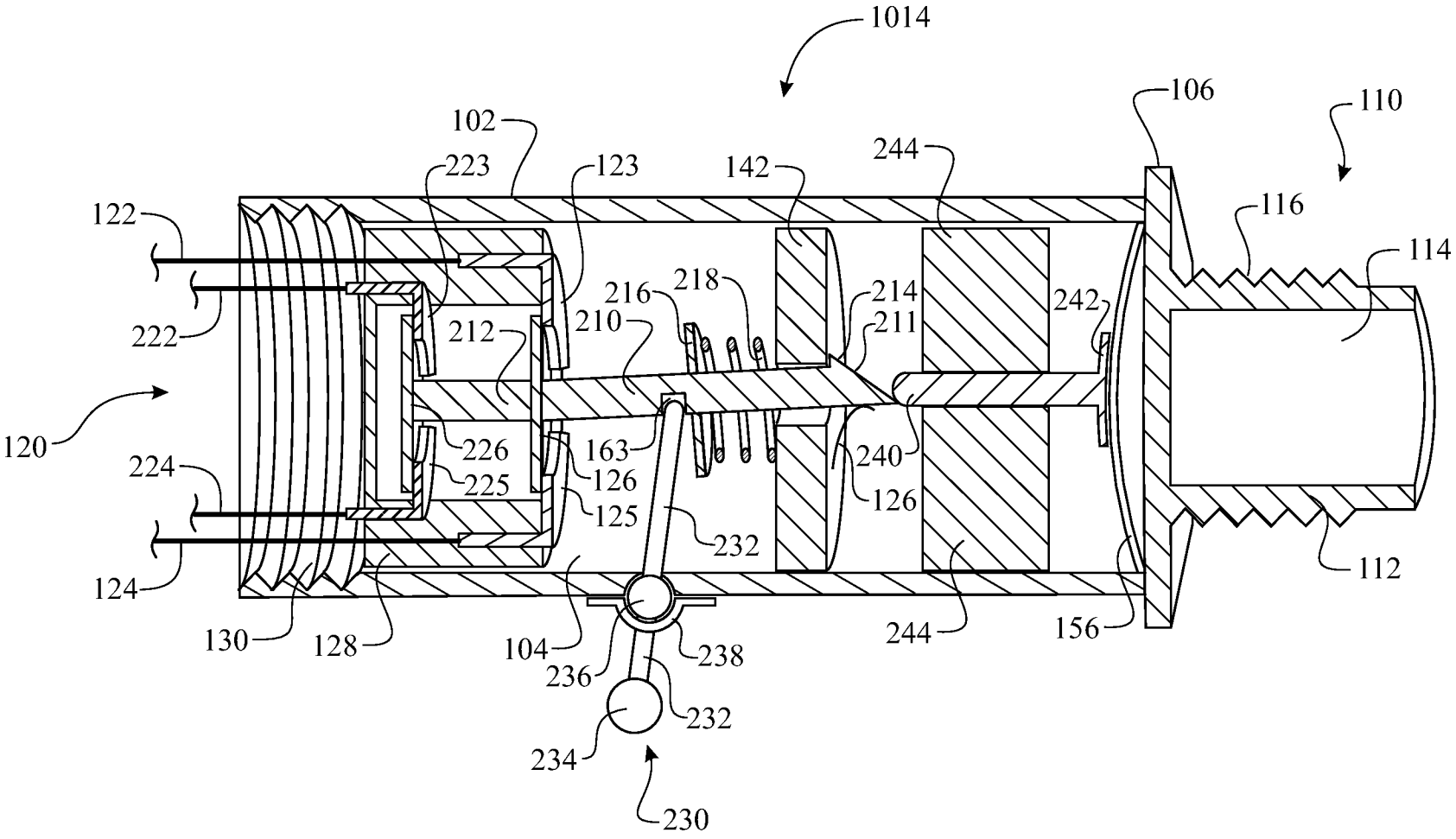
FIG. 29 is a sectioned elevation view of a thermally activated electrical interrupt switch utilizing a thermal expansion disc, presented in a closed circuit state.

A thermally activated electrical interrupt apparatus 1000 incorporating a pivotal reset assembly 230, a dual contact configuration, and a snap release circuit control configuration is referred to as 1013 and illustrated in FIGS. 27 and 28 and referred to as 1014 and illustrated in FIG. 29. A snap action actuation rod 210 is slideably maintained through a control rod bushing 142 mounted in the interrupt housing 102, and an interrupt rod extension 212 is slidably maintained through an interrupt rod sleeve 220 (FIG. 28) mounted in the circuit mounting member 128. An interrupt rod latching feature such as in the form of an interrupt rod latching notch 214 is formed on an actuating end of the snap action actuation rod 210. A circuit controlling contact 126 disposed between a rear end of the snap action actuation rod 210 and a forward end of the interrupt rod extension 212 forces the interrupt rod latching notch 214 to engage with a mating latching feature such as in the form of an edge of the control rod bushing 142 as illustrated in FIG. 29 when placed in a closed circuit state. The actuator or motor can be of any configuration. A wax motor configuration is presented in FIGS. 27 and 28, with a thermal expansion disc 156 being shown in FIG. 29. The thermally expanding material 114 expands when heated, forcing a formed diaphragm 204 (similar to the formed diagram 159 in FIG. 23) and an interrupt control rod 202, which contours to the protrusion of the formed diaphragm 204, to shift outward from the thermally expanding material 114. A control rod actuation face 208 is provided on an actuating end of the interrupt control rod 202, wherein the control rod actuation face 208 is slideably engaged with a tapered actuation face 211 being also formed on the actuating end of the snap action actuation rod 210. As the interrupt control rod 202 shifts, the control rod actuation face 208 slides along the tapered shape of the tapered actuation face 211, releasing the interrupt rod latching notch 214 from the edge of the control rod bushing 142. Alternately, the thermal expansion disc 156 is in mechanical communication with an interrupt rod 240. An optional interrupt rod flange 242 can be assembled to a thermal motor contacting end of the interrupt rod 240 to improve the interface between the interrupt rod 240 and the thermal expansion disc 156. A compression force applied by an activation biasing member 218 between a control rod flange 216 and the control rod bushing 142 causes the snap action actuation rod 210 and interrupt rod extension 212 to fire into an interrupt state (FIG. 28). It is understood that either contacting surface 208, 211 can be non-perpendicular to a longitudinal axis of the interrupt control rod 202 or the snap action actuation rod 210. For harsh environments, such as a lift station, the thermally activated electrical interrupt apparatus 1000 can include additional weather protecting covers, seals, and the like, such as the incorporation of a cover over the pivotal reset assembly 230.

The thermally activated electrical interrupt apparatus 1000 maintains an interrupt state until a service person pivots the pivotal reset assembly 230. The pivotal reset assembly 230 comprises a pivot shaft 232 having a pivot ball joint 236, which is captured within a pivot ball joint socket 238. A pivot knob 234 is disposed upon a user interfacing end of the pivot shaft 232, with the opposing, engaging end residing within the reset engaging notch 163 of a snap action actuation rod 210.

Change in the electrical state can be accomplished via any of a variety of configurations. It is understood the variations presented throughout the disclosure can be used with any combination of thermal motor, state control configuration, and the like. A dual contact configuration with like circuit states is presented in FIGS. 28 and 29. A dual contact configuration with opposing circuit states is presented in FIGS. 30 and 31. A plurality of contacts 126, 226 are assembled to the snap action actuation rod 210, separated via an interrupt rod extension 212. Each of the contacts 126, 226 are provided, contacting both the first electrical contact terminal 123, 223 and the second electrical contact terminal 125, 225 forming an electrical circuit. The contacts are in electrical communication with the balance of the power circuit via the first electrical conduit 122, 222 and second electrical conduit 124, 224. By changing the position of the circuit controlling contact 126 and circuit controlling contact 226, respective to the position of the contacts 123, 223, the designer can change the electrical connection from a like circuit configuration to an opposing circuit configuration.

Figure 30:
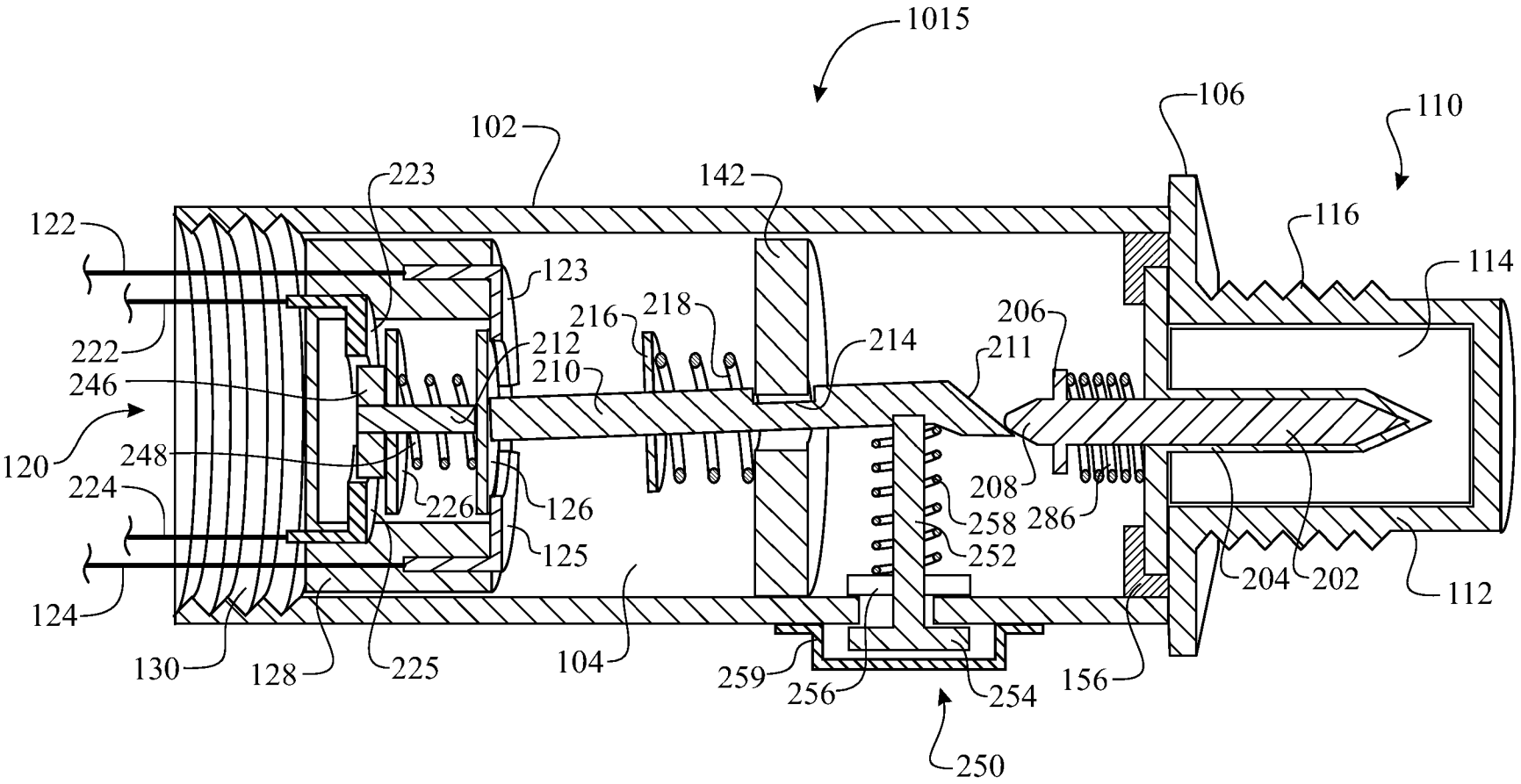
FIG. 30 is a sectional elevation view of a thermally activated electrical interrupt switch introducing a sliding reset configuration, further introducing an alternating circuit configuration.
Figure 31:
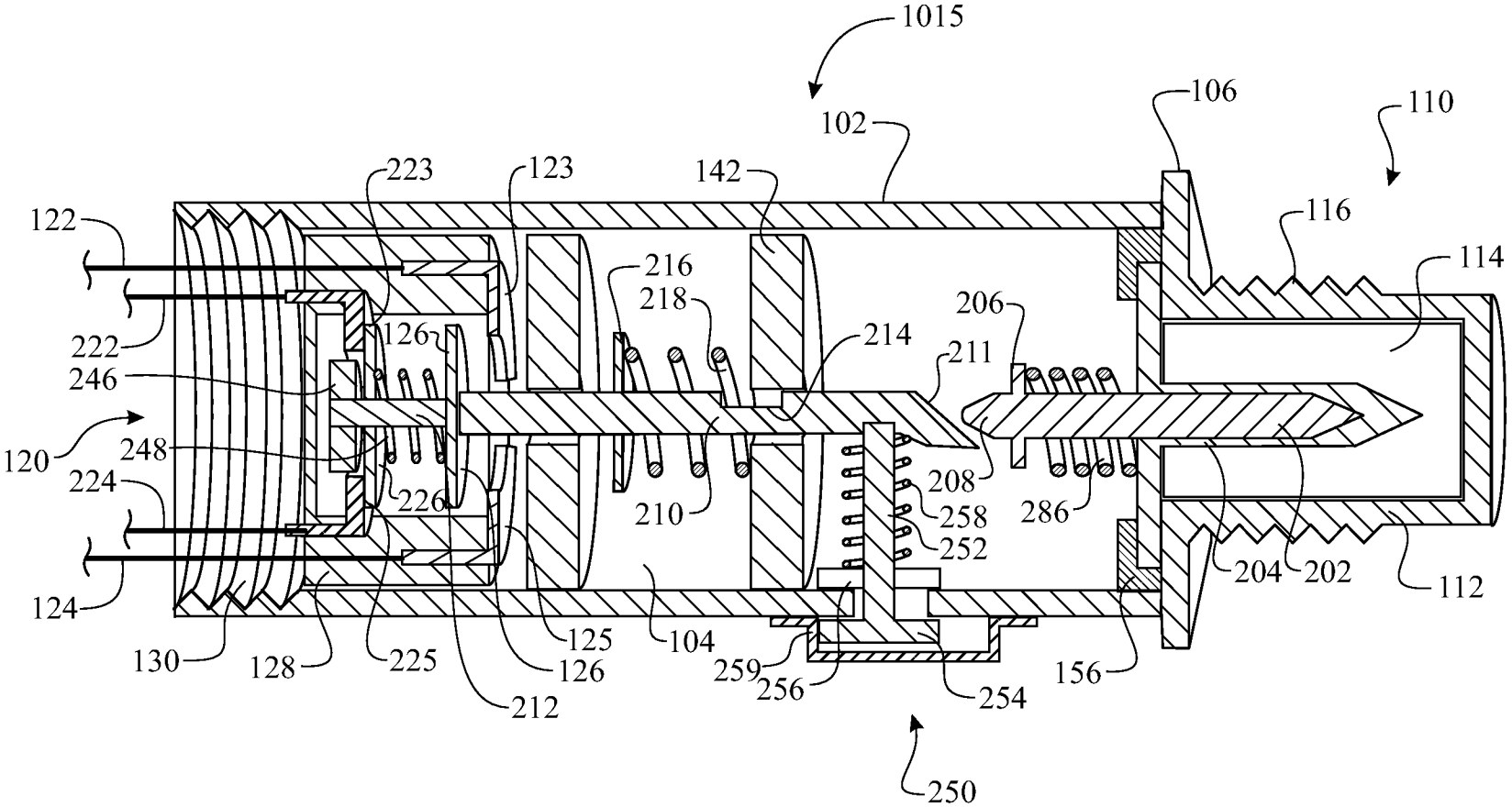
FIG. 31 is a sectional elevation view of a thermally activated electrical interrupt switch of FIG. 30, presented in an alternate circuit state.

A dimensional compensation feature can be incorporated, ensuring the controlling contacts 126, 226 form an adequate electrical interface between the first electrical contact terminal 123, 223 and the second electrical contact terminal 125, 225. One such means would utilize a compliant design for at least one of the contacting members. A second such means comprises a compensating configuration, as illustrated in FIGS. 30 and 31. An interrupt bushing 246 is affixed to a distal end of the interrupt rod extension 212. The interrupt bushing 246 can provide several benefits to the thermally activated electrical interrupt apparatus 1000, with a first benefit offering a registration bushing which slideably engages with an aperture provided through a center of the respective contacts 223, 225. The interrupt rod extension 212 can have a cross sectional shape that differs from (preferably smaller than) the cross sectional shape of the snap action actuation rod 210. The snap action actuation rod 210/interrupt rod extension 212 interface limits the motion of the contact 226 at the motor end, with the interrupt bushing 246 limiting the motion of the contact 126 at the distal end. The circuit controlling contact 126 and the circuit controlling contact 226 can be slideably assembled to the interrupt rod extension 212, limited in motion via the interrupt bushing 246 and the snap action actuation rod 210. The configuration allows each of the contacts 126, 226 to slideably adjust along the interrupt rod extension 212, being limited by the end features. A contact compensation spring 248 can be disposed between the two contacts 126, 226 ensuring the contacts apply positive pressure to each of the respective electrical contact pairs 123, 125/223, 225.

A firing mechanism can be provided by assembling a control rod flange 216 to the snap action actuation rod 210 and inserting an activation biasing member 218 between the facing wall of the control rod bushing 142 and control rod flange 216. When the thermally activated electrical interrupt apparatus 1000 is configured in a closed circuit state (FIG. 30) as represented by an exemplary embodiment referred to as thermally activated electrical interrupt apparatus 1015, the activation biasing member 218 is in a compressed (loaded) state. The snap action actuation rod 210 is sustained in a loaded position by engaging an interrupt rod latching notch 214 against an edge of the control rod bushing 142. An interrupt latching biasing member 258 (preferably a spring or similar) applies an offsetting force to the snap action actuation rod 210 directing the interrupt rod latching notch 214 to engage properly.

The interrupt control rod 202 is driven by the wax motor consisting of the thermally expanding material 114 and the formed diaphragm 204. A tension return spring 286 is provided as a tension spring returning the interrupt control rod 202 into the thermally expanding material 114 as the temperature decreases and the thermally expanding material 114 shrinks. A control rod flange 206 can be provided as a means for securing the tension return spring 286 to the interrupt control rod 202. A control rod actuation face 208 is preferably formed having a slanted or conically shaped face for aiding in engagement with the tapered actuation face 211 of the snap action actuation rod 210. As the thermally expanding material 114 is heated, the thermally expanding material 114 expands driving the interrupt control rod 202 towards the snap action actuation rod 210. The angled interface directs the snap action actuation rod 210 against the compression force applied by the interrupt latching biasing member 258, thus releasing the interrupt rod latching notch 214 from the control rod bushing 142. Once released, the compression force stored by the activation biasing member 218 fires the snap action actuation rod 210, almost instantaneously changing state of the respective contacts. This particular configuration virtually eliminates any potential arcing that could result from the slow expansion of the thermally expanding material 114.

A slideable reset assembly 250 is another optional configuration providing a means for resetting a thermally activated electrical interrupt apparatus 1000 (shown as embodiment apparatus 1015) in an interrupt state. The slideable reset assembly 250 would be slideably assembled to the interrupt housing 102. A reset assembly shaft 252 is provided between the snap action actuation rod 210 and a reset assembly slide 254. The interrupt latching biasing member 258 can be assembled over the reset assembly shaft 252, providing the latching driving force to the snap action actuation rod 210. A slide backing 256 can be provided into the reset assembly shaft 252 maintaining the 250 in the proper assembly as well as being a supporting member to the interrupt latching biasing member 258. A reset mechanism seal 259 can be assembled to the thermally activated electrical interrupt apparatus 1015 covering the slideable reset assembly 250, providing a weatherproof seal.

Figure 32:
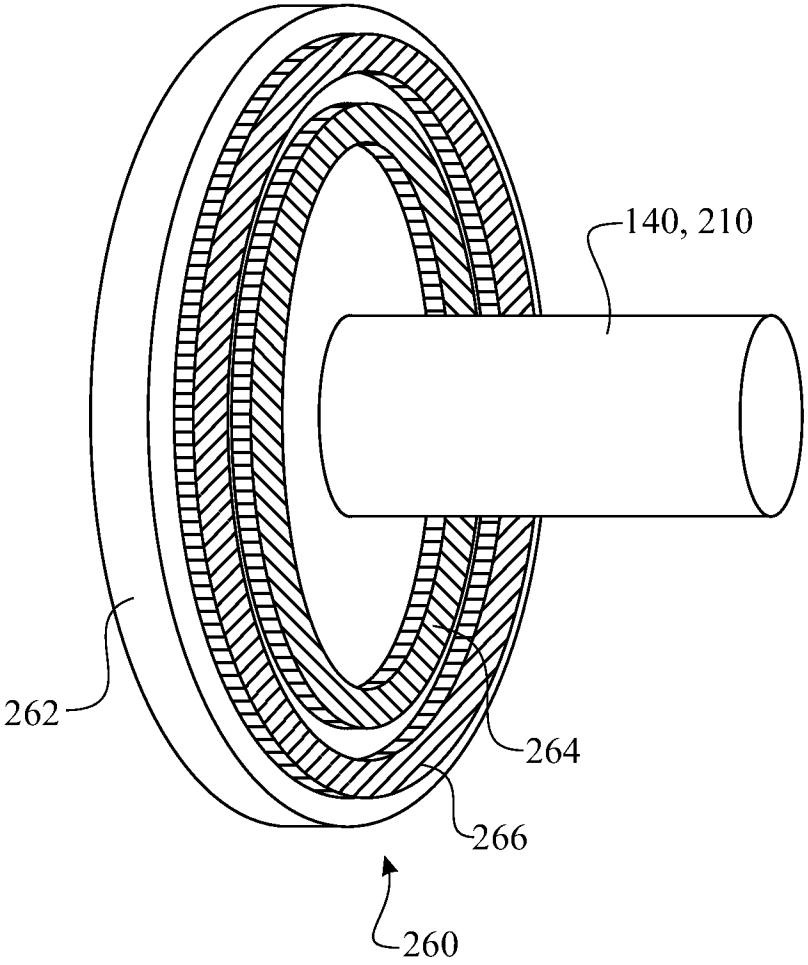
FIG. 32 is an alternate exemplary embodiment of a multi-circuit actuator.

An alternate exemplary embodiment of an electrical contact configuration is herein referred to as a multi-circuit contact assembly 260 is best illustrated in FIG. 32. A multi-contact interface member 262 is disposed upon a terminal end of the interrupt control rod 140, 210. A plurality of electrical contacts, such as the exemplary first contact 264, and second contact 266 are disposed upon a contacting surface of the multi-contact interface member 262. Each of the contacting rings 264, 266 is associated with a pair of contact terminals (not shown). The electrical contacts can be placed on either face of the multi-contact interface member 262, or on opposing sides, or any combination therewith. It is understood that any reasonable number of electrical contacts can be utilized in the configuration.

Figure 33:
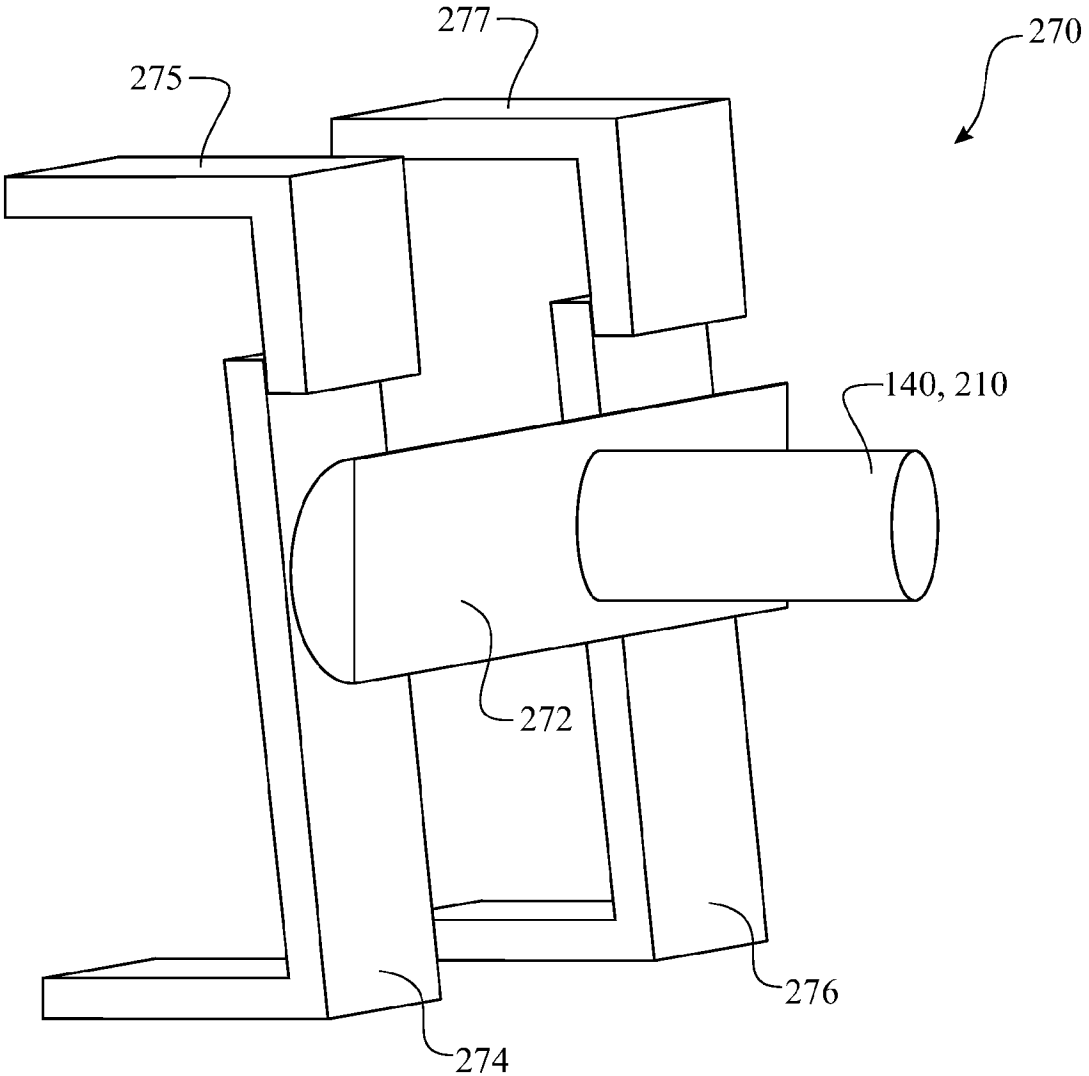
FIG. 33 is another alternate exemplary embodiment of a multi-circuit actuator.

Yet another alternate exemplary embodiment of an electrical contact configuration, referred to as a multi-circuit contact assembly 270 is best illustrated in FIG. 33. A multi-circuit actuator 272 is disposed upon a terminal end of the interrupt control rod 140, 210. The multi-circuit actuator 272 opens and closes a circuit between each of a first circuit contact comprising a first cantilevered contact 274 and a first contact terminal 275 and a second circuit contact comprising a second cantilevered contact 276 and a second contact terminal 277. It is understood that any reasonable number of electrical contacts can be utilized in the configuration.

Figure 34:
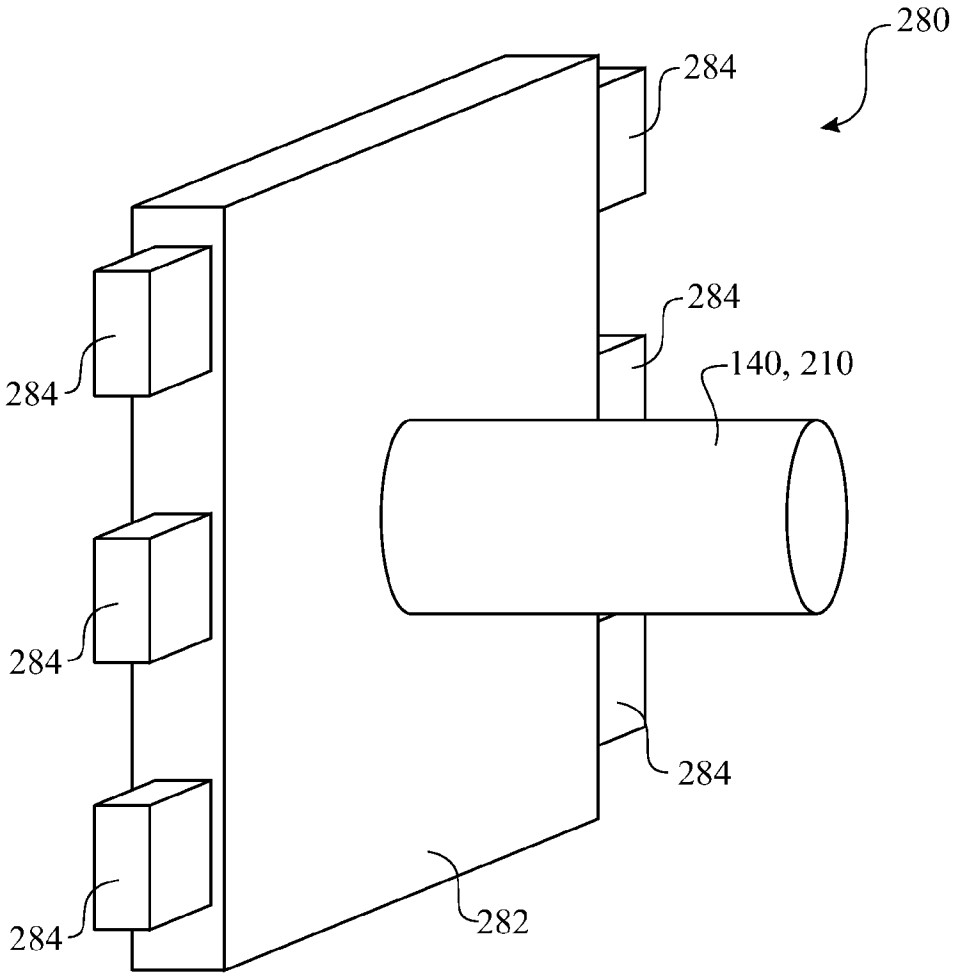
FIG. 34 is yet another alternate exemplary embodiment of a multi-circuit actuator.

Yet another alternate exemplary embodiment of an electrical contact configuration, referred to as a multi-circuit contact assembly 280 is best illustrated in FIG. 34. A contact assembly 282 is disposed upon a terminal end of the interrupt control rod 140, 210. A plurality of contacts 284 is disposed through the 282, providing electrical continuity between a first terminal edge and a second terminal edge. The assembly can be flat (as shown) or arched to provide a spring action, positive contact force. Non-conductive insulation ribs can be slideably arranged between the contacts 284. It is understood that any reasonable number of electrical contacts can be utilized in the configuration.

Figure 35:
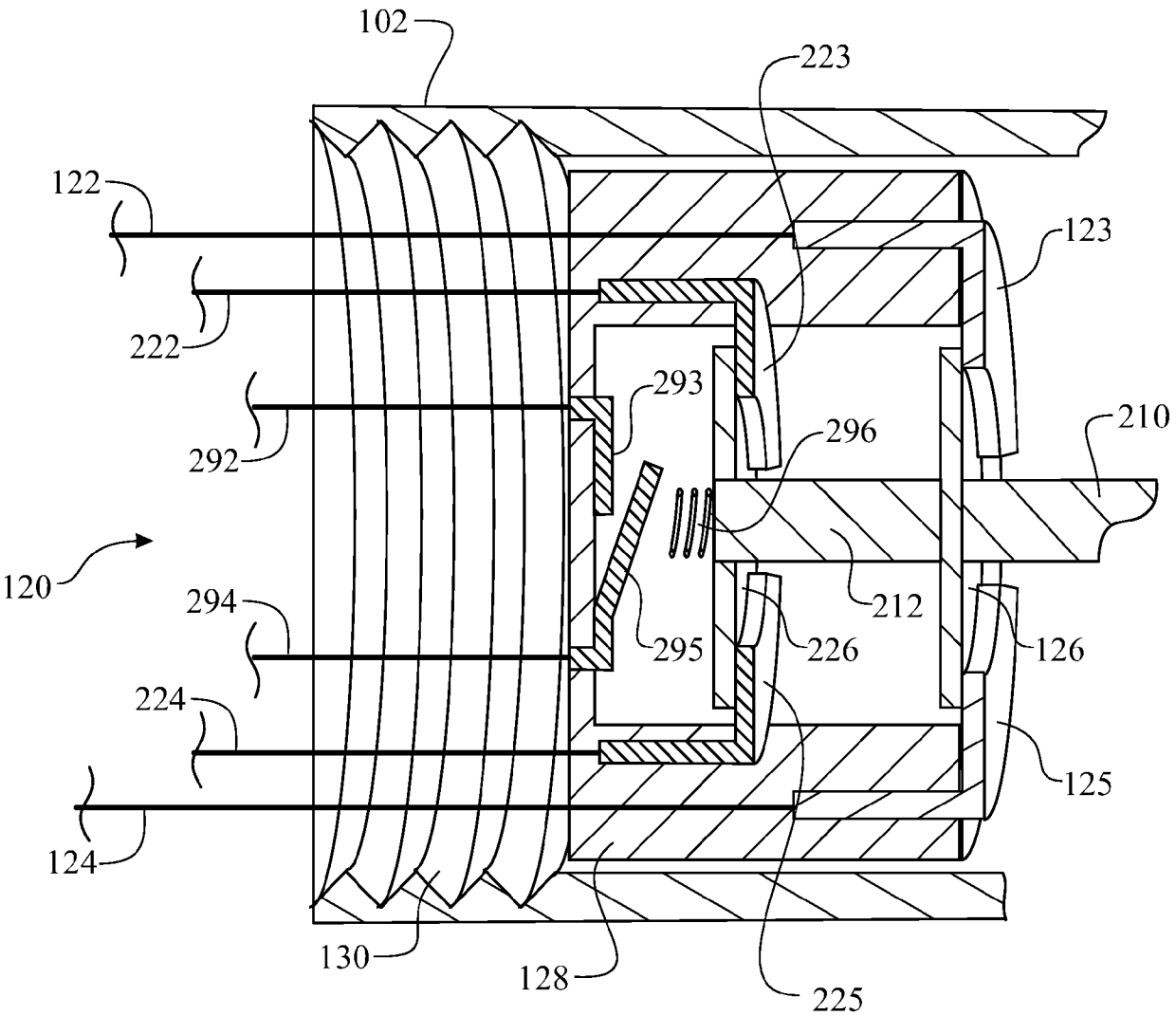
FIG. 35 is a sectional elevation view of an exemplary embodiment incorporating an alarm circuit.

A like circuit configuration incorporating a cantilever style alarm circuit is illustrated in FIG. 35. An alarm control circuit can be provided having electrical communication to the thermally activated electrical interrupt apparatus 1000 via a stationary contact electrical conductor 292 and a cantilever electrical conductor 294. Each of the conductors 292, 294 is connected to an electrical contact terminal 293, 295. An optional actuation spring 296 can be assembled to an alarm circuit actuating end of the interrupt rod extension 212. When the thermally activated electrical interrupt apparatus 1000 is elevated to an interrupt temperature, the snap action actuation rod 210 is fired, forcing the actuation assembly to shift in a direction away from the thermal motor. This motion applies a force to the cantilever alarm contact 295 causing it to contact the stationary alarm contact 293, forming a closed circuit, thus activating the attached alarm. It is understood the circuit can be applied to any desired electrically operated system.

Figure 36:
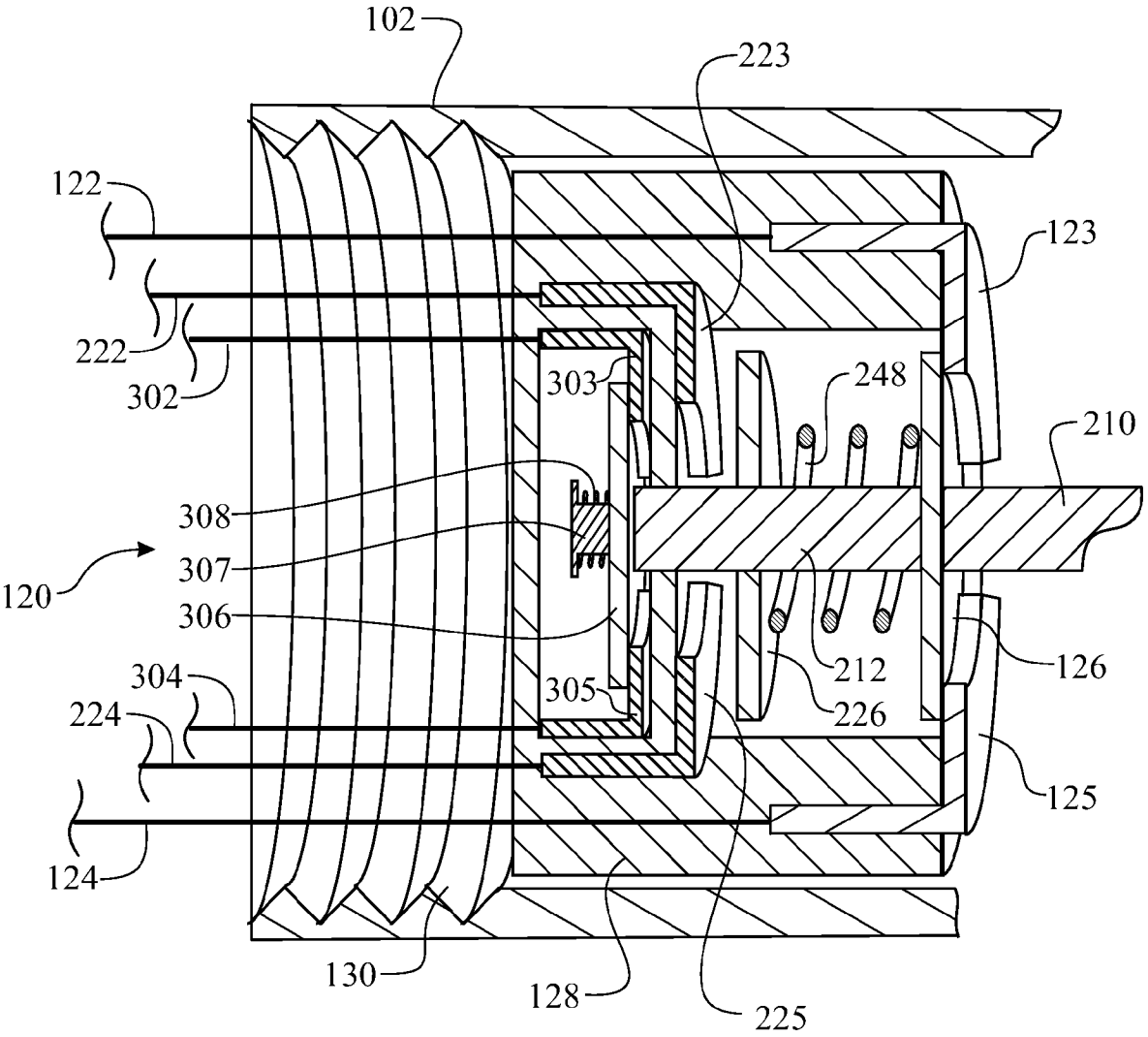
FIG. 36 is a sectional elevation view of an alternate exemplary embodiment incorporating an alarm circuit.

A multi-circuit configuration utilizing plunger style contacts is illustrated in FIG. 36. Two of the contacts can be used to control power with a third optionally controlling an alarm circuit. The previously disclosed opposing circuit incorporates a third circuit. The third circuit includes a pair of conductors 302, 304, each in electrical communication with a respective terminal contact 303, 305. A compression assembly 307 can be disposed on the distal end of the interrupt rod extension 212. A compression spring 308 is preferably assembled in compression, applying a force to a circuit controlling contact 306 ensuring the circuit controlling contact 306 remains in contact with the contact terminals 303, 305 as desired. The configuration, as shown, allows for two circuits in a first state and one circuit in an opposing state. One of the circuits can be utilized in conjunction with an alarm.

Figure 37:
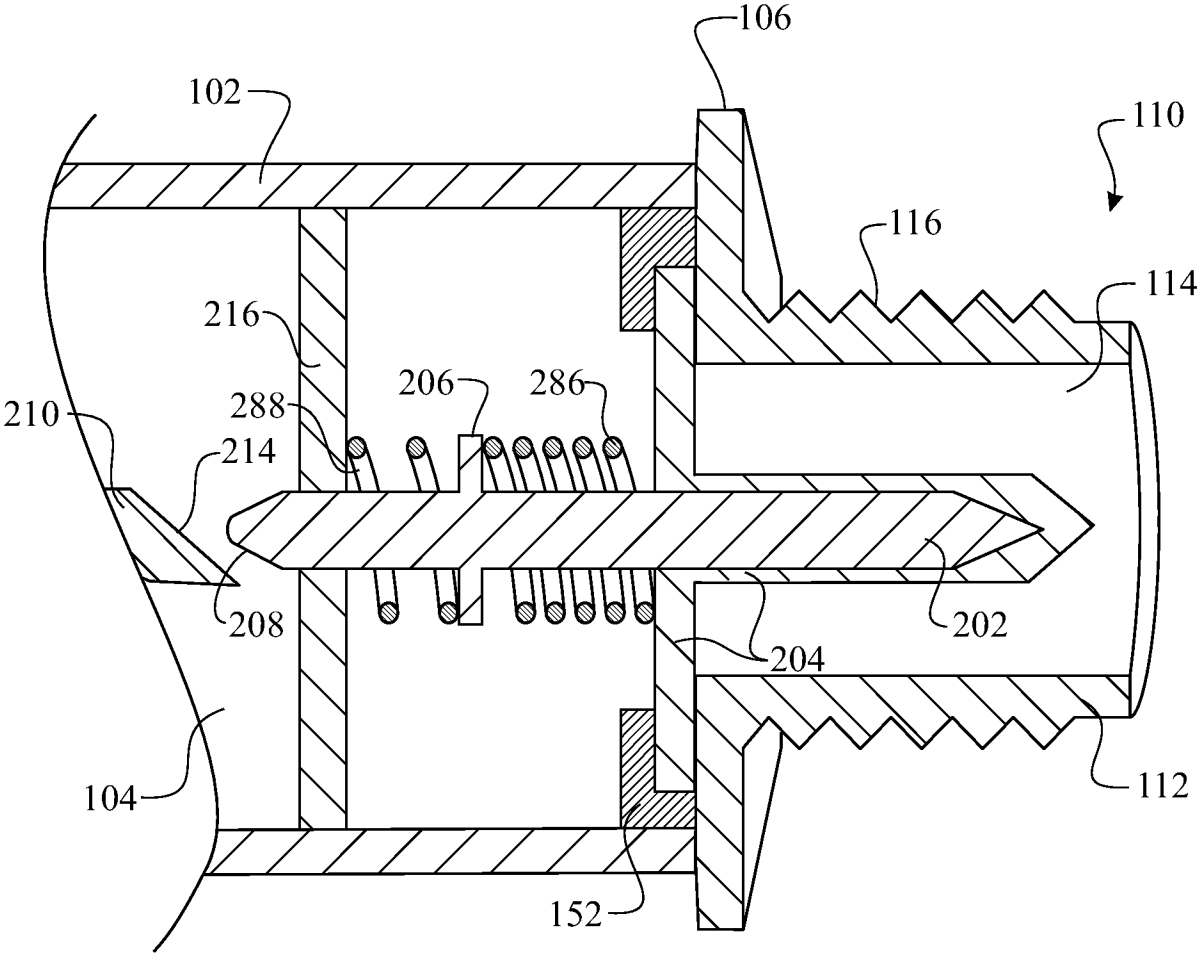
FIG. 37 is a magnified view of a wax motor incorporating an actuator support and two options of a return spring.

Several optional features for aiding in operation of the interrupt control rod 202 are presented in FIG. 37. A control rod flange 216 can be assembled within the interrupt housing 102. The interrupt control rod 202 is assembled slideably extending through an aperture of the control rod flange 216. The control rod flange 216 ensures the interrupt control rod 202 remains in proper registration with the interrupt rod latching notch 214 of the snap action actuation rod 210. A return spring can be incorporated to ensure the interrupt control rod 202 returns to a closed circuit state. The return spring can be either a tension return spring 286 or a compression return spring 288, applying the return force to the control rod flange 206.

Figure 38:
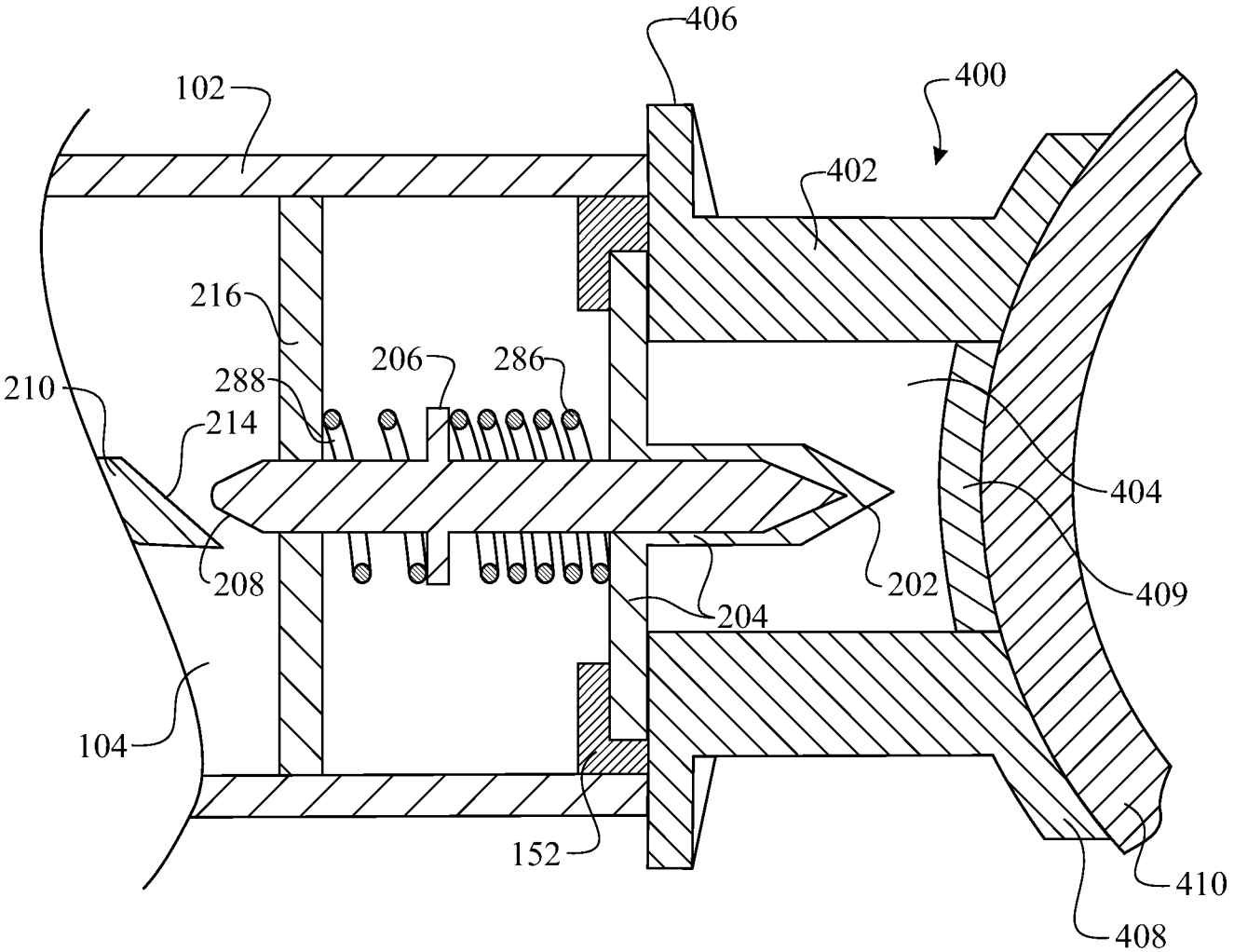
FIG. 38 is a sectional elevation view of a wax motor and mounting portion of a thermally activated electrical interrupt switch an alternate mounting interface.

An alternate mounting configuration is best presented as adhesive mounting wax motor assembly 400 shown in FIG. 38. The adhesive mounting wax motor assembly 400 comprises a wax motor enclosure 402 formed in a tubular shape for encapsulating the thermally expanding material 404. A motor to interrupt interface 406 is disposed about a first edge of the wax motor enclosure 402 and a thermal mounting interface 408 is disposed about the opposing edge of the wax motor enclosure 402. A cavity end wall 409 provides an end wall within the cavity formed for encapsulating the thermally expanding material 404. The cavity end wall 409 can be a plug type of assembly or integrated into the enclosure 402. The thermal mounting interface 408 is preferably formed having an arched surface providing a fit surface for adhesively securing the wax motor enclosure 402 to a piping 410. The interrupt housing 102 is secured to the motor to interrupt interface 406 using any interface securing means known by those skilled in the art.

Figure 39:
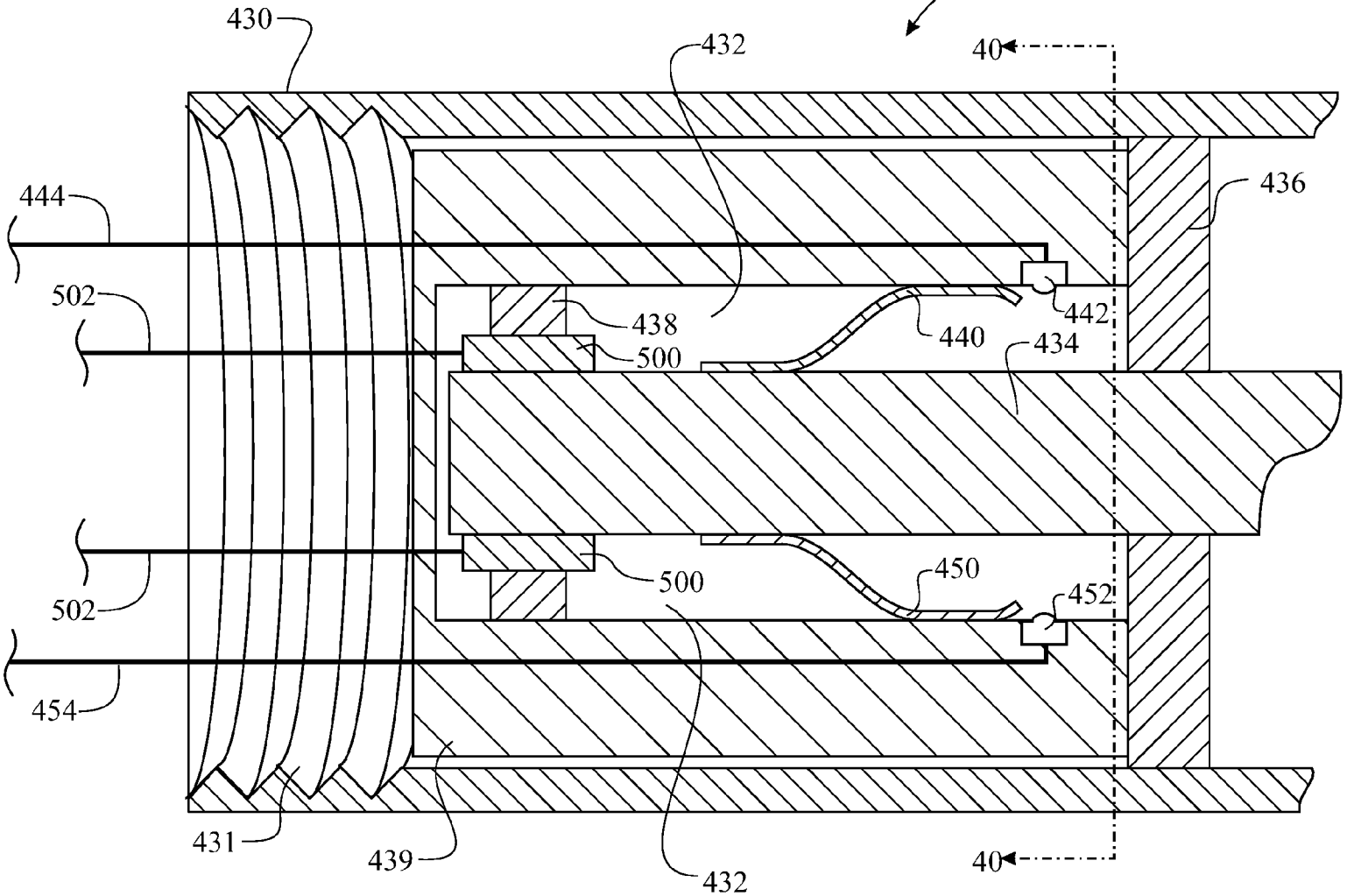
FIG. 39 is a sectional elevation view of an interrupt portion of a thermally activated electrical interrupt switch, additionally introducing a solenoid for remotely controlling the actuator shaft.
Figure 40:
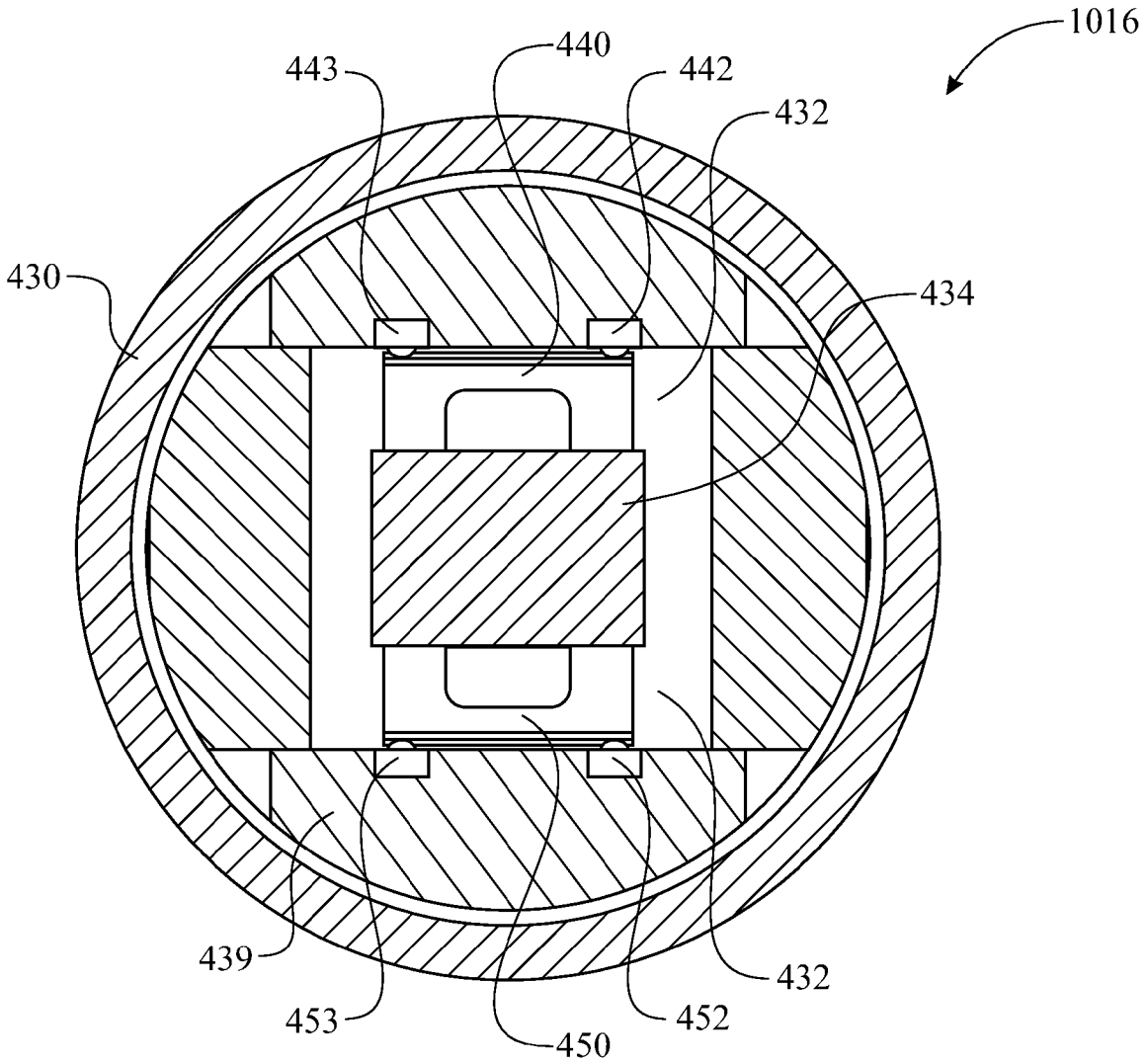
FIG. 40 is a sectional elevation view of the interrupt portion of a thermally activated electrical interrupt switch, taken along section 40-40 of FIG. 39.

A slide switch configuration is best presented in FIG. 39 and end view FIG. 40. The thermally activated electrical interrupt apparatus 1000, 1001 (illustrated as apparatus embodiment 1016) can incorporate an interrupt apparatus electrical housing section 430, having a mechanical coupling 431 formed within an interior cavity at an electrical connectivity end of the interrupt apparatus electrical housing section 430. An actuation shaft central sleeve 436 is formed in a central region of an interior of the interrupt apparatus electrical housing section 430. An actuation shaft 434 is slideably assembled through an aperture within a central portion of the actuation shaft central sleeve 436. An actuation shaft distal sleeve 438 is provided approximate a distal end of the actuation shaft 434, wherein said actuation shaft 434 is slideably assembled through an aperture within a central portion of the actuation shaft central sleeve 436. At least one electrical sliding contact 440, 450 is assembled to the actuation shaft 434. Each electrical sliding contact 440, 450 forms an electrical interconnection switch between two adjacent electrical conductor contacts 442, 443/452, 453 respectively. The electrical communication continues through a plurality of electrical conductors 444, 454. At least one insulation material 439 is disposed within an electrical contact cavity 432 of the interrupt apparatus electrical housing section 430 providing a mounting structure for the electrical conductors 444, 454 and respective electrical conductor contacts 442, 443/452, 453. The illustrations present a thermally activated electrical interrupt apparatus 1015 having a contact configuration on each of two opposing sides. It is understood, the contact configuration can be incorporated on any or all sides and the cross sectional shape can be any desired shape. The number of contacts can vary as well, allowing for multi-phase power or multiple independent circuits. Further, each circuit can be normally open, normally closed or a combination therein.

An optional actuator control solenoid 500 for remotely controlling the reset process of the actuation shaft 434 can be incorporated within the apparatus, as illustrated in FIG. 39. The actuator control solenoid 500 is secured via a solenoid mount 438. Power is provided to the actuator control solenoid 500 via a pair of solenoid power conductors 502. When the actuation shaft 434 is positioned into an interrupt state, the actuator control solenoid 500 maintains the shaft in that position. A monitoring circuit can direct the actuator control solenoid 500 to aid in repositioning the actuation shaft 434, returning the thermally activated electrical interrupt apparatus 1016 into an active state. Details of the actuator control solenoid 500 to actuation shaft 434 operation and interface are well understood by those skilled in the art. One such design would provide a uni-directional grip to the actuation shaft 434, securing the actuation shaft 434 in an interrupt state. Upon activation of the actuator control solenoid 500, the actuator control solenoid 500 would release the uni-directional grip from the actuation shaft 434, allowing the actuation shaft 434 to return to an active state. The concept presented can utilize alternate automated securing devices, such as grippers, and the like, incorporating any automated securing device known by those in the art.

Figure 41:
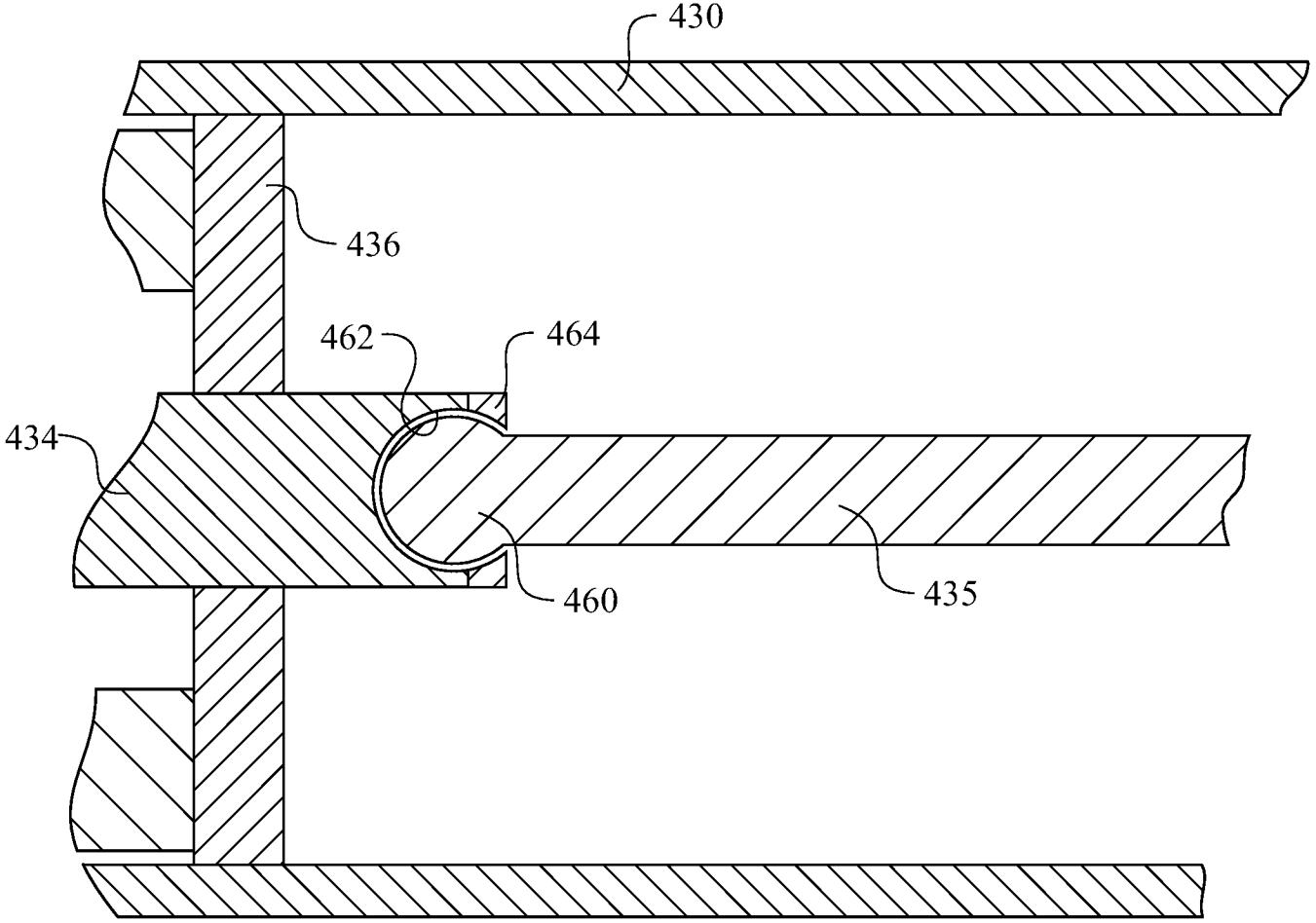
FIG. 41 is a sectional elevation view of a flexible interface positioned between a motor shaft and an actuation shaft of a thermally activated electrical interrupt switch.

An optional flexible interface is illustrated in FIG. 41. The illustrated flexible interface presents an exemplary embodiment being a ball and socket joint. In the exemplary embodiment, a motor shaft ball joint 460 is disposed upon a distal end of the motor shaft 435, and inserted into a ball joint receiving cavity 462 of the actuation shaft 434. A ball joint end cap 464 entraps the motor shaft ball joint 460 within the ball joint receiving cavity 462. The ball and socket joint creates a flexible interface between the actuation shaft 434 and the motor shaft 435. It is understood that other flexible interface designs can be provided forming a flexible interface between the actuation shaft 434 and the motor shaft 435.

Applications for the thermally activated electrical interrupt apparatus 1000 exist, wherein the thermally activated electrical interrupt apparatus 1000 would be subjected to any of a variety of harsh conditions, such as moisture, shock, and the like. A thermally activated electrical interrupt apparatus 1000 incorporating features specifically design to function in harsh environments is best presented in FIGS. 42 and 43. The thermally activated electrical interrupt apparatus 1000, 1001 (illustrated as apparatus embodiment 1017) presents various optional features to protect the thermally activated electrical interrupt apparatus 1000 when subjected to harsh conditions. A reset system is completely confined internally to the thermally activated electrical interrupt apparatus 1000. An interrupt switch housing 602 provides a primary enclosure to the thermally activated electrical interrupt apparatus 1000. The interrupt switch housing 602 and the thermally activated engine portion 110 are designed of a shape, dimensions, and material conducive to protecting the apparatus 1017 in the designated harsh environment. A thermally activated engine portion 110 is disposed at a thermal interface end of the interrupt switch housing 602. A reset access cover 600 is removably coupled to a reset end of the interrupt switch housing 602, with the exemplary mechanical coupler 604 being a threaded interface. A cover seal 606 can be assembled between an edge of the reset access cover 600 and a housing seal flange 608 disposed upon the interrupt switch housing 602 providing a moisture impervious seal. A series of actuator o-ring seals 612 can be assembled about interfaces between moving components, such as providing a seal between an electric switch frame member 610 and actuation shaft 640 proximate a reset end of the actuation shaft 640. A strain relief seal 614 can be incorporated providing a seal and strain relief for the first electrical conductor 444 at the first electrical conductor 444—interrupt switch housing 602 interface. In addition to moisture control, the actuator o-ring seals 612 dampen any shock transfer through the apparatus.

Figure 42:
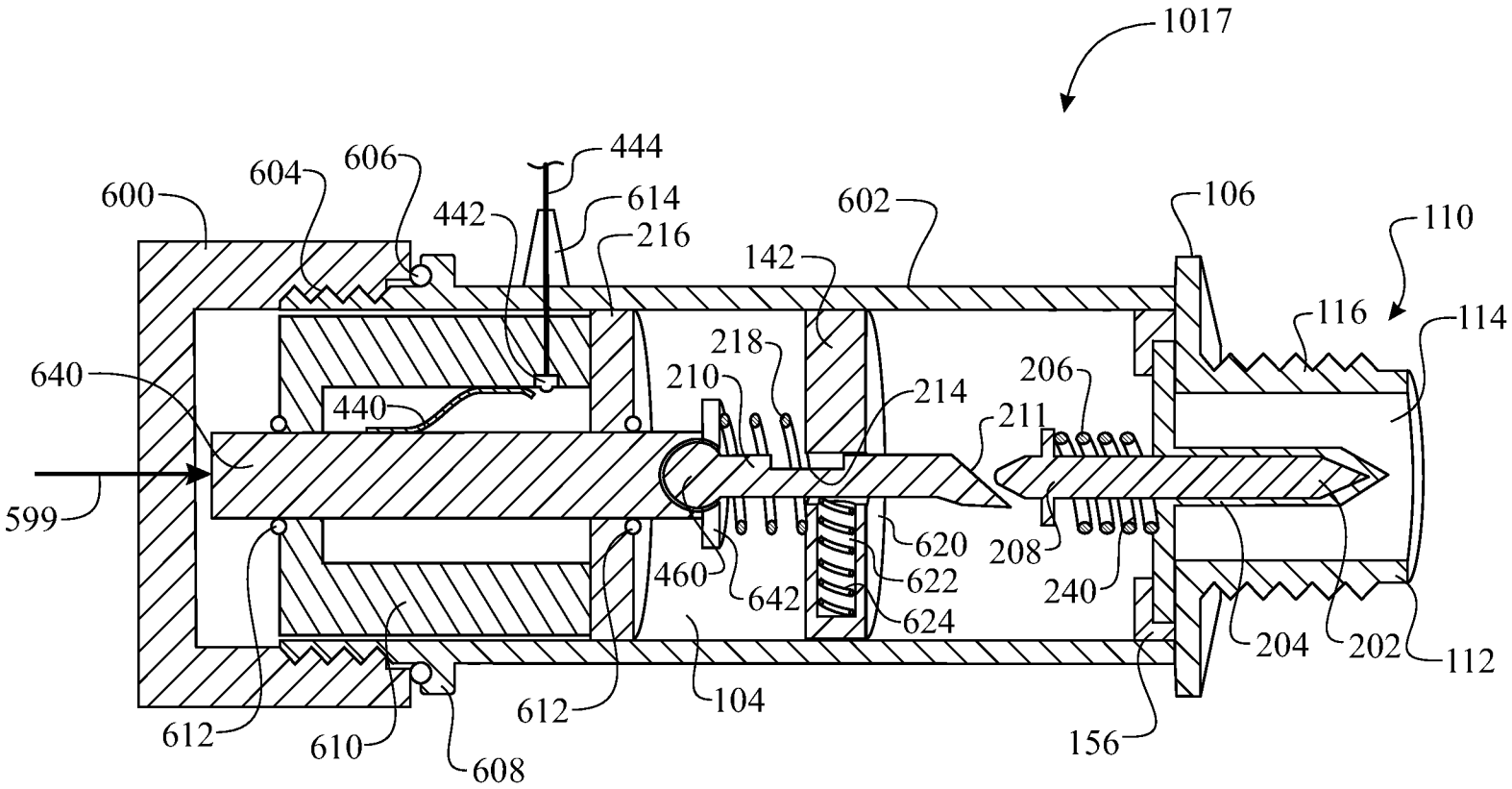
FIG. 42 is a sectional elevation view of an alternate exemplary embodiment incorporating various features for applications in harsh environments, presented in a circuit interrupt state.
Figure 43:
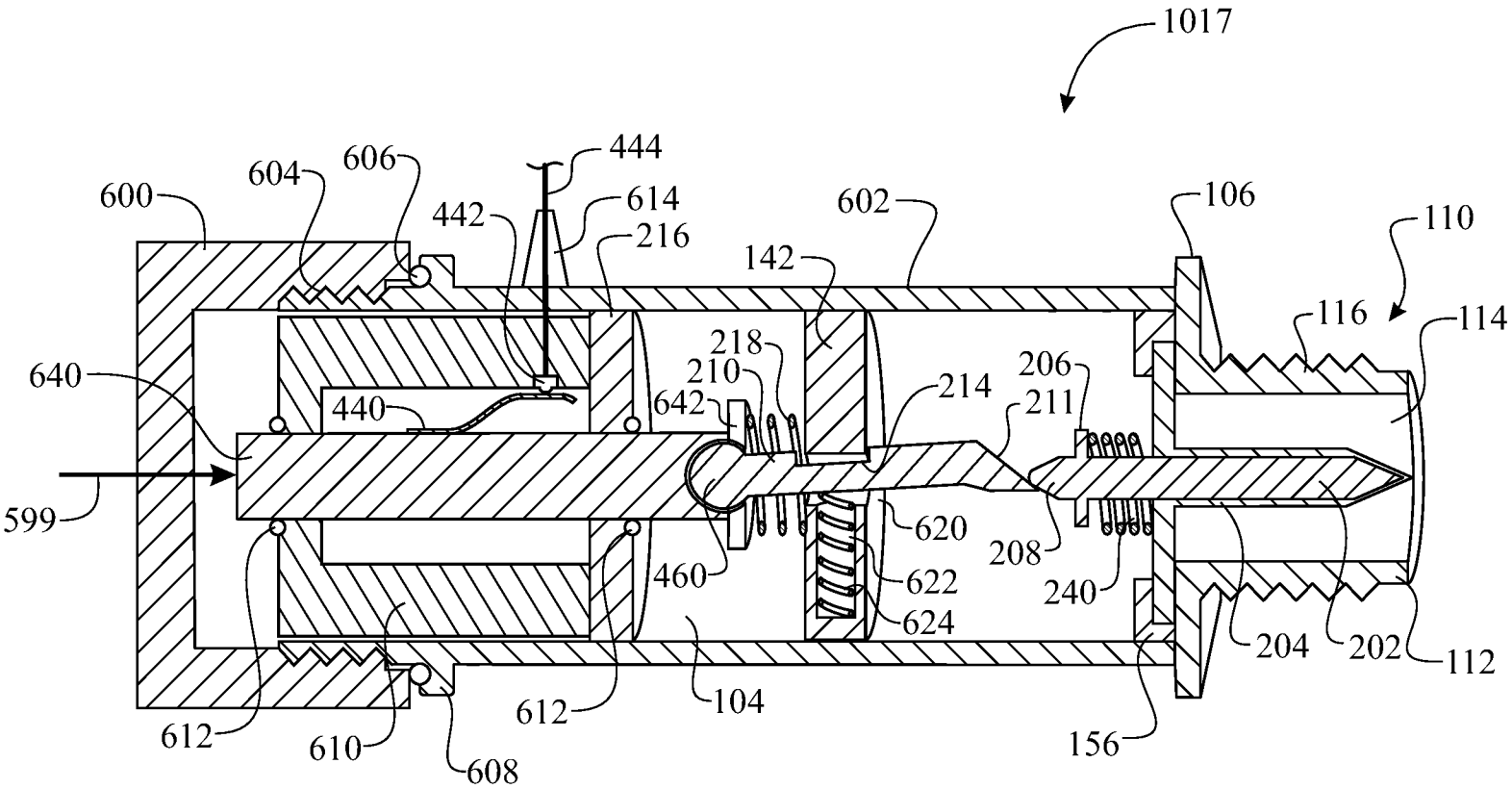
FIG. 43 is a sectional elevation view of an alternate exemplary embodiment of FIG. 42, presented in a closed circuit state.

The exemplary embodiment incorporates the snap release mechanism previously presented, utilizing an interrupt rod latching notch 214 engaging with an edge of an aperture within the actuation shaft bushing 620 to maintain the thermally activated electrical interrupt apparatus 1000 in a circuit interrupt state (FIG. 42). When heated, the thermally expanding material 114 expands, forcing the control rod actuation face 208 against a tapered actuation face 211 causing the interrupt rod latching notch 214 to disengage from the aperture edge of the actuation shaft bushing 620. The activation biasing member 218 applies an expansion force between the actuation shaft bushing 620 and an actuation shaft flange 642 assembled to the actuation shaft 640, forcing the actuation shaft 640 to shift changing the state in any incorporated electrical circuit. In the exemplary embodiment, first electrical sliding contact 440 changes state of electrical communication with first electrical conductor contact 442 providing the change in state of the circuit. Upon activation of the interrupt switch, the user would manually reset the thermally activated electrical interrupt apparatus 1000 by applying a reset force 599 to a distal end of the actuation shaft 640. The reset force 599 pushes the actuation shaft 640 and attached snap action actuation rod 210 towards the thermally activated engine portion 110 until the interrupt rod latching notch 214 reengages with the edge of an aperture within the actuation shaft bushing 620. An actuator biasing member 624 is disposed within a biasing member cavity 622 of the actuation shaft bushing 620. The actuator biasing member 624 is preferably a compression spring, but can be of any fitting form factor, which applies a force to the snap action actuation rod 210. The biasing force ensures the interrupt rod latching notch 214 engages with the edge of the aperture of the actuation shaft bushing 620.

While the preferred embodiments of the invention have been described above, it will be recognized and understood that various modifications can be made in the invention and the appended claims are intended to cover all such modifications which may fall within the spirit and scope of the invention.

We claim:

1. A method of operating an electrical circuit based upon a change in temperature of a system, the method comprising the steps of:

obtaining a thermally activated electrical interrupt switch comprising:

an interrupt switch housing;

an interrupt control rod comprising a first end defined as a control rod actuation face and an opposite end defined as an engine interface portion;

a thermally activated engine portion comprising a thermally expanding material being expandable or contractible so as to thermally monitor an increase or decrease in temperature of a system, said thermally expanding material being in communication with said engine interface portion of said interrupt control rod, said thermally activated engine portion being assembled to a first end of said interrupt switch housing;

at least one pair of mating electrical contacts forming an electrical circuit;

a snap action actuation rod comprising a first end defined as a complimenting actuation face, said snap action actuation rod in operational communication with said at least one pair of mating electrical contacts; and at least one of said control rod actuation face and said complimenting actuation face include a contacting surface that is angled respective to a longitudinal axis of said snap action actuation rod;

assembling said interrupt switch housing to a thermally monitored system;

retaining said snap action actuation rod in a first thermal monitoring position placing said electrical circuit in a first electrical connection state; and expanding said thermally expanding material respective to an increase in temperature of said thermally monitored system to a second thermal monitoring position, wherein said expanded thermally expanding material repositions said interrupt control rod axially, forcing said control rod actuation face of said interrupt control rod against said complimenting actuation face of said snap action actuation rod, wherein said angled contacting surface releases said snap action actuation rod from said first thermal monitoring position, placing said electrical circuit in a second electrical connection state.

2. A method of operating an electrical circuit based upon a change in temperature of a system as recited in claim 1, the method further comprising the steps of:

retaining said snap action actuation rod in said first thermal monitoring position by engaging a latching feature on said snap action actuation rod with a mating latching feature in said interrupt switch housing.

3. A method of operating an electrical circuit based upon a change in temperature of a system as recited in claim 1, the method further comprising the steps of:

retaining said snap action actuation rod in a first thermal monitoring position by engaging a latching notch located on said snap action actuation rod with a mating engaging latching feature, wherein said mating latching feature is an edge of a bushing defining an aperture through said bushing, wherein said bushing is disposed upon an interior of said interrupt switch housing and said snap action actuation rod is assembled through said bushing aperture.

4. A method of operating an electrical circuit based upon a change in temperature of a system as recited in claim 1, the method further comprising the steps of:

retaining said snap action actuation rod in said first thermal monitoring position by engaging a latching notch located on said snap action actuation rod with a mating engaging feature in said interrupt switch housing.

5. A method of operating an electrical circuit based upon a change in temperature of a system as recited in claim 2, the method further comprising the steps of:

applying a retention biasing force to said snap action actuation rod, wherein said retention biasing force retains said latching feature engaged with said mating latching feature until said angled contacting surface releases said snap action actuation rod from said first thermal monitoring position.

6. A method of operating an electrical circuit based upon a change in temperature of a system as recited in claim 1, said method further comprising said steps of:

applying an activation biasing force to said snap action actuation rod, wherein said activation biasing force further aids in a transition between said first electrical connection state and said second electrical connection state.

7. A method of operating an electrical circuit based upon a change in temperature of a system as recited in claim 1, the method further comprising the steps of:

resetting said snap action actuation rod to said first thermal monitoring position returning said electrical circuit to said first electrical connection state.

8. A method of operating an electrical circuit based upon a change in temperature of a system as recited in claim 1, wherein said thermally activated electrical interrupt switch further comprising a second pair of mating electrical contacts forming a second electrical circuit, the method further comprising the steps of:

changing a state of said second electrical circuit from a normal electrical connection state to an interrupt electrical connection state during said repositioning of said interrupt control rod axially.

9. A method of operating an electrical circuit based upon a change in temperature of a system as recited in claim 8, wherein said step of changing said state of said electrical circuit and said second electrical circuit sets one electrical circuit into an open circuit configuration and said other electrical circuit into a closed circuit configuration.

10. A method of operating an electrical circuit based upon a change in temperature of a system as recited in claim 8, wherein said step of changing said state of said electrical circuit and said second electrical circuit sets each circuit in like configurations.

11. A method of operating an electrical circuit based upon a change in temperature of a system, the method comprising the steps of:

obtaining a thermally activated electrical interrupt switch comprising:

an interrupt switch housing;

an interrupt control rod comprising a first end defined as a control rod actuation face and an opposite end defined as an engine interface portion;

a thermally activated engine portion comprising a thermally expanding material being expandable or contractible so as to thermally monitor an increase or decrease in temperature of a system, said thermally expanding material being in communication with said engine interface portion of said interrupt control rod, said thermally activated engine portion being assembled to a first end of said interrupt switch housing;

at least one pair of mating electrical contacts forming an electrical circuit;

a snap action actuation rod comprising a first end defined as a complimenting actuation face, said snap action actuation rod in operational communication with said at least one pair of mating electrical contacts;

at least one of said control rod actuation face and said complimenting actuation face include a contacting surface that is angled respective to a longitudinal axis of said snap action actuation rod;

a latching feature on said snap action actuation rod; and a mating latching feature in said interrupt switch housing, said latching feature being engageable with said mating latching feature;

assembling said interrupt switch housing at said first end thereof to a thermally monitored system;

retaining said snap action actuation rod in a first thermal monitoring position, placing said electrical circuit in a first electrical connection state, by engaging said latching feature with said mating latching feature;

applying a retention biasing force to said snap action actuation rod, wherein said retention biasing force retains said snap action actuation rod in said first thermal monitoring position and said latching feature engaged with said mating latching feature until said angled contacting surface releases said snap action actuation rod from said first thermal monitoring position; and expanding said thermally expanding material respective to an increase in temperature of said thermally monitored system to a second thermal monitoring position, wherein said expanded thermally expanding material repositions said interrupt control rod axially, forcing said control rod actuation face of said interrupt control rod against said complimenting actuation face of said snap action actuation rod, wherein said angled contacting surface releases said snap action actuation rod from said first thermal monitoring position, placing said electrical circuit in a second electrical connection state, by disengaging said latching feature from said mating latching feature.

12. A method of operating an electrical circuit based upon a change in temperature of a system as recited in claim 11, wherein said latching feature is a latching notch, the method further comprising the steps of:

retaining said snap action actuation rod in said first thermal monitoring position by engaging said latching notch of said snap action actuation rod with said mating latching feature.

13. A method of operating an electrical circuit based upon a change in temperature of a system as recited in claim 12, further wherein said mating latching feature is an edge of a bushing defining an aperture therethrough, said bushing is disposed on an interior of said interrupt switch housing, and said snap action actuation rod is assembled through said bushing aperture, the method further comprising the steps of:

retaining said snap action interrupt rod in said first thermal monitoring position by engaging said locking notch of said snap action actuation rod with said edge of said bushing.

14. A method of operating an electrical circuit based upon a change in temperature of a system as recited in claim 11, said method further comprising said steps of:

applying an activation biasing force to said snap action actuation rod, wherein said activation biasing force further aids in a transition between said first electrical connection state and said second electrical connection state.

15. A method of operating an electrical circuit based upon a change in temperature of a system as recited in claim 11, the method further comprising the steps of:

resetting said snap action actuation rod to said first thermal monitoring position returning said electrical circuit to said first electrical connection state.

16. A method of operating an electrical circuit based upon a change in temperature of a system as recited in claim 11, said thermally activated electrical interrupt switch further comprising a second pair of mating electrical contacts forming a second electrical circuit, the method further comprising the steps of:

changing a state of said second electrical circuit from a normal electrical connection state to an interrupt electrical connection state during said repositioning of said interrupt control rod axially.

17. A method of operating an electrical circuit based upon a change in temperature of a system as recited in claim 16, wherein said step of changing said state of said electrical circuit and said second electrical circuit sets one electrical circuit into an open circuit configuration and said other electrical circuit into a closed circuit configuration.

18. A method of operating an electrical circuit based upon a change in temperature of a system as recited in claim 16, wherein said step of changing said state of said electrical circuit and said second electrical circuit sets each circuit in like configurations.

19. A method of operating an electrical circuit based upon a change in temperature of a system, the method comprising the steps of:

obtaining a thermally activated electrical interrupt switch comprising:

an interrupt switch housing;

an interrupt control rod comprising a first end defined as a control rod actuation face and an opposite end defined as an engine interface portion;

a thermally activated engine portion comprising a thermally expanding material being expandable or contractible so as to thermally monitor an increase or decrease in temperature of a system, said thermally expanding material being in communication with said engine interface portion of said interrupt control rod, said thermally activated engine portion being assembled to a first end of said interrupt switch housing;

at least one pair of mating electrical contacts forming an electrical circuit;

a snap action rod comprising a first end defined as a complimenting actuation face, said snap action rod in operational communication with said at least one pair of mating electrical contacts; and at least one of said control rod actuation face and said complimenting actuation face include a contacting surface that is angled respective to a longitudinal axis of said snap action actuation rod;

assembling said interrupt switch housing to a thermally monitored system;

retaining said snap action rod in a first thermal monitoring position placing said electrical circuit in a first electrical connection state;

applying an activation biasing force to said snap action rod, wherein said activation biasing force further aids in a transition between said first electrical connection state and a second electrical connection state;

expanding said thermally expanding material respective to an increase in temperature of said thermally monitored system to a second thermal monitoring position, wherein said expanded thermally expanding material repositions said interrupt control rod axially, forcing said control rod actuation face of said interrupt control rod against said complimenting actuation face of said snap action actuation rod, wherein said angled contacting surface releases said snap action actuation rod from said, first thermal monitoring position, placing said electrical circuit in said second electrical connection state; and resetting said snap action actuation rod to said first thermal monitoring position returning said electrical circuit to said first electrical connection state.

* * * * *